US010898778B2

(12) United States Patent
Pack et al.

(10) Patent No.: US 10,898,778 B2
(45) Date of Patent: Jan. 26, 2021

(54) TRAINING DEVICE

(71) Applicants: Michael Pack, Roswell, GA (US); Charles Pack, Roswell, GA (US)

(72) Inventors: Michael Pack, Roswell, GA (US); Charles Pack, Roswell, GA (US)

( * ) Notice: Subject to any disclaimer, the term of this patent is extended or adjusted under 35 U.S.C. 154(b) by 0 days.

(21) Appl. No.: 15/832,231

(22) Filed: Dec. 5, 2017

(65) Prior Publication Data

US 2018/0154234 A1 Jun. 7, 2018

Related U.S. Application Data

(60) Provisional application No. 62/585,146, filed on Nov. 13, 2017, provisional application No. 62/430,073, filed on Dec. 5, 2016.

(51) Int. Cl.

| | |
|---|---|
| ***A63B 69/00*** | (2006.01) |
| ***A63B 63/08*** | (2006.01) |
| ***A63B 17/04*** | (2006.01) |

(52) U.S. Cl.

CPC ..... *A63B 69/0071* (2013.01); *A63B 17/04* (2013.01); *A63B 63/083* (2013.01); *A63B 2210/50* (2013.01); *A63B 2225/055* (2013.01); *A63B 2225/09* (2013.01)

(58) Field of Classification Search

CPC ..... A63B 69/0071; A63B 63/083; A63B 2225/09

See application file for complete search history.

(56) References Cited

U.S. PATENT DOCUMENTS

| | | | |
|---|---|---|---|
| 1,410,149 | A | 3/1922 | Williams |
| D269,691 | S | 7/1983 | Ornstein |
| 4,406,450 | A | 9/1983 | Regan |
| D279,911 | S | 7/1985 | Thompson |
| 4,854,573 | A | 8/1989 | Johannson |
| D308,555 | S | 6/1990 | Hermen |
| D345,468 | S | 3/1994 | McVicker |
| D352,191 | S | 11/1994 | Zorian |
| D355,005 | S | 1/1995 | Voohanel, Jr. |
| 5,752,341 | A | 5/1998 | Goldfarb |
| D432,603 | S | 10/2000 | Bullard, Jr. |
| D438,858 | S | 3/2001 | del Castillo |
| D487,124 | S | 2/2004 | Toniolo |
| D562,016 | S | 2/2008 | Tomasch |
| 7,780,575 | B1 | 8/2010 | Goodwin, III |
| 8,075,425 | B2 | 12/2011 | Conwright |
| 8,079,915 | B2 | 12/2011 | Spencer |

(Continued)

OTHER PUBLICATIONS

USPTO Notice of Allowance, U.S. Appl. No. 29/630,482, dated Jun. 22, 2020 (10 pgs).

*Primary Examiner* — Jeffrey S Vanderveen
(74) *Attorney, Agent, or Firm* — Ballard Spahr LLP

(57) ABSTRACT

A training device for teaching and practicing ball handling skills for basketball players or persons training for sports, the training device including stanchions positionable on a floor using attachment members, such as suction cups, or a flexible resilient layer. A crossbar extends between the stanchions. Flexible elements can be used to connect the stanchions to the suction cups. The lengths of the stanchions and crossbar can be adjustable to set the height of the crossbar above the floor and the separation of the crossbars. Detents can allow for adjustably fixing the lengths.

10 Claims, 15 Drawing Sheets

(56) References Cited

U.S. PATENT DOCUMENTS

| | | | | |
|---|---|---|---|---|
| D707,775 | S | 6/2014 | May | |
| D750,719 | S | 3/2016 | Holland | |
| D764,607 | S | 8/2016 | Beckford | |
| 9,504,866 | B2 | 11/2016 | Peralo | |
| D786,380 | S | 5/2017 | Chang | |
| 9,675,829 | B1 * | 6/2017 | Katz | A63B 1/00 |
| D833,547 | S | 11/2018 | Weber | |
| D834,669 | S | 11/2018 | Goodman | |
| D843,520 | S | 3/2019 | Thompson | |
| D844,078 | S | 3/2019 | Salomone | |
| D846,664 | S | 4/2019 | Martinez | |
| 10,500,465 | B1 | 12/2019 | Panaia | |
| 2005/0130806 | A1 * | 6/2005 | Lopez | A63B 23/12 482/38 |
| 2007/0249434 | A1 * | 10/2007 | Starr | A63B 69/0071 473/422 |
| 2008/0293519 | A1 | 11/2008 | Inn | |
| 2009/0158572 | A1 * | 6/2009 | Connerley | A63B 63/083 29/426.1 |
| 2011/0294606 | A1 | 12/2011 | Llyod | |
| 2013/0143694 | A1 | 6/2013 | Conwright | |
| 2013/0237394 | A1 | 9/2013 | Fowler | |
| 2014/0371040 | A1 | 12/2014 | Vasquez | |
| 2015/0126335 | A1 | 5/2015 | Gilson | |
| 2016/0129302 | A1 | 5/2016 | Vallo | |
| 2017/0072260 | A1 * | 3/2017 | Jackson | A63B 23/1218 |
| 2017/0252622 | A1 * | 9/2017 | Ross | A63B 69/0059 |
| 2017/0318961 | A1 * | 11/2017 | Ramirez | F16M 11/24 |
| 2018/0056116 | A1 * | 3/2018 | Le Nguyen | A63B 23/1227 |
| 2018/0104558 | A1 | 4/2018 | Sweeney | |

* cited by examiner

TRAINING DEVICE

CROSS-REFERENCE TO RELATED APPLICATION

This application claims priority to U.S. Provisional Application No. 62/585,146, filed Nov. 13, 2017 and to U.S. Provisional Application No. 62/430,073, filed Dec. 5, 2016. The disclosures of the above-referenced applications are hereby incorporated herein by reference in their entirety.

FIELD OF THE INVENTION

This invention relates to training devices and kits used to teach, practice and improve ball handling, shooting or agility skills for an individual.

BACKGROUND

Ball handling skills, in particular, mastery of the various types of dribbles, may be considered a close second, if not equal, to shooting skills with respect to the fundamentals of the game of basketball. It is vital for players to establish a firm foundation and good habits in the techniques for advancing the ball, and to be able to recognize the need for and to transition seamlessly between the various types of dribbles as required by the tactical situation on the court. While the high or speed dribble may be effective for rapid movement on an open court, the ball cannot be protected effectively and is vulnerable to being stolen. When defenders are encountered, the player must be able to transition from the high dribble into the crouch of the low dribble to afford the ball protection, and then explode into a lay-up or a pass. Additional dribble skills, such as the cross-over dribble, between the legs dribble and behind the back dribble, combined with head and shoulder fakes, once practiced and mastered, will produce a player respected for his effectiveness.

There is clearly an advantage to be realized if training devices, specially designed to develop and practice superior ball handling skills, are used for training. Additionally, such devices can be used in connection with a number of additional training and sports-related exercises. Thus, there is a need in the pertinent art for improved training devices that can be used to efficiently and efficiently develop various athletic skills and performance capabilities of individuals.

SUMMARY

Described herein are training devices securable to a floor, the training device comprising: a first base having at least one suction cup for attaching the first base to the floor; a first stanchion extending from the first base transversely to the floor; a second base having at least one suction cup for attaching the second base to the floor; a second stanchion extending from the second base transversely to the floor; and a crossbar extending from the first stanchion to the second stanchion. In some aspects, each one of the first and second bases can have two suction cups for attaching the first and second bases to the floor. While various embodiments of the present disclosure are described herein as having at least one suction cup, it is to be understood that, except as set forth herein, the various embodiments of training devices can instead comprise one or more of any attachment member that is suitable for securing the first and second bases to a floor or the ground. For example and without limitation, such suitable attachment members can include a suction cup, a vacuum cup, an adhesive, a clamp, a stake, a latch, a bolt, a screw, or combinations thereof. It is contemplated that the attachment member of the first base can have be the same as or different than the attachment member of the second base. In some aspects, each of the first and second stanchions can comprise a first tube positioned coaxially within a second tube, the second tube being attached to the base, the crossbar being attached to the first tube, the first and second tubes being axially movable relatively to one another. In some aspects, the training device can further comprise, for each stanchion, a detent operable between the first and second tubes for fixing a length of the first and second stanchions.

Described herein are training devices securable to a floor, the training device comprising: a first base having at least one suction cup for attaching the first base to the floor; a first stanchion extending from the first base transversely to the floor; a second base having at least one suction cup for attaching the second base to the floor; a second stanchion extending from the second base transversely to the floor; and a crossbar extending from the first stanchion to the second stanchion, wherein the crossbar comprises a first tube positioned coaxially within a second tube, the first and second tubes being axially movable relatively to one another. In some aspects, the training device can further comprise a detent operable between the first and second tubes for fixing a length of the crossbar.

Described herein are training devices securable to a floor, the training device comprising: a first base having at least one suction cup for attaching the first base to the floor; a first stanchion extending from the first base transversely to the floor; a second base having at least one suction cup for attaching the second base to the floor; a second stanchion extending from the second base transversely to the floor; and a crossbar extending from the first stanchion to the second stanchion, wherein the crossbar comprises: a sleeve; a first tube arranged coaxially within the sleeve and extending from one end thereof; and a second tube arranged coaxially within the sleeve and extending from another end thereof, the first and second tubes being axially movable relatively to the sleeve. In some aspects, the training device can further comprise: a first detent operable between the sleeve and the first tube; a second detent operable between the sleeve and the second tube, the detents for fixing a length of the crossbar.

Described herein are training devices securable to a floor, the training device comprising: a first base having at least one suction cup for attaching the first base to the floor; a first stanchion extending from the first base transversely to the floor; a second base having at least one suction cup for attaching the second base to the floor; a second stanchion extending from the second base transversely to the floor; and a crossbar extending from the first stanchion to the second stanchion, wherein the training device further comprises: a first collar mounted on the first stanchion distal to the first base; a second collar mounted on the second stanchion distal to the second base; a first socket receiving a first end of the crossbar; a first lug extending from the first socket, the first lug receiving the first stanchion and being supported on the first collar; a second socket receiving a second end of the crossbar; and a second lug extending from the second socket, the second lug receiving the second stanchion and being supported on the second collar.

Described herein are training devices securable to a floor, the training device comprising: a first suction cup attachable to the floor; a first flexible element attached to the first suction cup; a first stanchion extending from the first flexible element transversely to the floor; a second suction cup attachable to the floor; a second flexible element attached to the second suction cup; a second stanchion extending from the second flexible element transversely to the floor; and a crossbar extending from the first stanchion to the second stanchion, wherein the first and second flexible elements each have bending stiffnesses less than a bending stiffness of the first and second stanchions, respectively. In some aspects, each of the first and second stanchions can comprise: a first tube positioned coaxially within a second tube, the first tube being attached to the flexible element, the crossbar being attached to the second tube, the first and second tubes being axially movable relatively to one another.

By way of example the training device can further comprise, for each stanchion, a detent operable between first and second tubes for fixing a length of first and second stanchions.

Described herein are training devices securable to a floor, the training device comprising: a first suction cup attachable to the floor; a first flexible element attached to the first suction cup; a first stanchion extending from the first flexible element transversely to the floor; a second suction cup attachable to the floor; a second flexible element attached to the second suction cup; a second stanchion extending from the second flexible element transversely to the floor; and a crossbar extending from the first stanchion to the second stanchion, wherein the first and second flexible elements each have bending stiffnesses less than a bending stiffness of the first and second stanchions, respectively, and wherein the crossbar comprises: a first tube positioned coaxially within a second tube, the first and second tubes being axially movable relatively to one another. In some aspects, the training device can further comprise a detent operable between the first and second tubes for fixing a length of the crossbar. In some aspects, the first and second flexible elements can comprise respective coil springs. In some aspects, the first and second flexible elements can comprise respective elastomeric bodies.

Disclosed herein are training devices securable to a floor, the training device comprising: a first suction cup attachable to the floor; a first tube having a first end attached to the first suction cup and a second end oppositely disposed; a second suction cup attachable to the floor; a second tube having a first end attached to the second suction cup and a second end oppositely disposed; a crossbar extending between the second ends of the first and second tubes, the crossbar having first and second ends oppositely disposed; a first fitting having a first receptacle receiving the second end of the first tube and a second receptacle receiving the first end of the crossbar, the first and second receptacles of the first fitting being angularly oriented with respect to one another; and a second fitting having a first receptacle receiving the second end of the second tube and a second receptacle receiving the second end of the cross bar, the first and second receptacles of the second fitting being angularly oriented with respect to one another. In some aspects, the training device can further comprise: a first flexible element positioned between the first suction cup and the first end of the first tube; and a second flexible element positioned between the second suction cup and the first end of the second tube, wherein the first and second flexible elements each have bending stiffnesses less than a bending stiffness of the first and second tubes respectively. In some aspects, the first and second flexible elements can comprise respective coil springs. In some aspects, the first and second flexible elements can comprise respective elastomeric bodies.

Disclosed herein are training device securable to a floor, the training device comprising: a first suction cup attachable to the floor; a first tube having a first end attached to the first suction cup and a second end oppositely disposed; a second suction cup attachable to the floor; a second tube having a first end attached to the second suction cup and a second end oppositely disposed; a crossbar extending between the second ends of the first and second tubes, the crossbar having first and second ends oppositely disposed; a first fitting having a first receptacle receiving the second end of the first tube and a second receptacle receiving the first end of the crossbar, the first and second receptacles of the first fitting being angularly oriented with respect to one another; and a second fitting having a first receptacle receiving the second end of the second tube and a second receptacle receiving the second end of the crossbar, the first and second receptacles of the second fitting being angularly oriented with respect to one another. In some aspects, the first tube can be coaxially received within the first receptacle of the first fitting and the second tube can be coaxially received within the first receptacle of the second fitting, the first tube being axially movable relatively to the first receptacle of the first fitting and the second tube being axially movable relatively to the first receptacle of the second fitting. In some aspects, the training device can further comprise a first detent operable between the first tube and the first fitting; and a second detent operable between the second tube and the second fitting, the first and second detents for fixing a height of the crossbar above the floor. In some aspects, the first end of the crossbar can be coaxially received within the second receptacle of the first fitting and the second end of the crossbar can be coaxially received within the second receptacle of the second fitting, the crossbar being axially movable relatively to the second receptacle of the first fitting and the second receptacle of the second fitting. In some aspects, the training device can further comprise: a first detent operable between the crossbar and the first fitting; and a second detent operable between the crossbar and the second fitting, the first and second detents for fixing a separation distance between the first and second tubes.

Another example embodiment of a training device positionable on a floor according to the invention comprises a first base having, for example, a trapezoidal shape comprising a long side and a short side attached to one another by first and second legs oriented angularly with respect to the long and short sides. While described herein as having a trapezoidal shape, it is contemplated that the first and second bases can comprise any shape that can be used to achieve the functionality of the respective base, such as for example, a trapezoid, a rectangle, a square, a parallelogram, or the like. For those aspects having a trapezoidal shape, the long side can be configured to engage the floor. A first stanchion can extend from the first trapezoidal base transversely to the floor. A second trapezoidal base can comprise a long side and a short side attached to one another by first and second legs oriented angularly with respect to the long and short sides of the second trapezoidal base. The long side of the second trapezoidal base can be configured to engage the floor. A second stanchion can extend from the second trapezoidal base transversely to the floor. A crossbar can extend from the first stanchion to the second stanchion. The crossbar can be oriented transversely to the long side of at least one of the first and second trapezoidal bases.

In an example embodiment, at least one of the first and second trapezoidal bases can have a flexible, resilient layer positioned on one of the long sides for engaging the floor. In a specific example, the flexible, resilient layer comprises a plurality of pads positioned in spaced relation to one another on the long side of the at least one trapezoidal base.

By way of example, each of the first and second stanchions comprises a plurality of tubes positioned coaxially one within another. The tubes can be movable relatively to one another. In an example embodiment, at least one of the stanchions can comprise a first tube positioned coaxially within a second tube, the second tube being coaxially positioned within a third tube, the third tube being attached to the base. The crossbar can be attached to the first tube.

In an example embodiment, for each stanchion, a detent can operate between each of the tubes for fixing a length of the first and second stanchions.

In an example embodiment, the crossbar comprises a plurality of cross tubes positioned coaxially one within another. The cross tubes are movable relatively to one another. In a specific example embodiment, the crossbar comprises a first cross tube positioned coaxially within a second cross tube. The first and second cross tubes are axially movable relatively to one another. An example embodiment may further comprise a detent operable between the first and second cross tubes for fixing a length of the crossbar.

In an example, embodiment the crossbar can comprise a first socket positioned at an end of the first cross tube. The first socket can define a first opening for receiving the first stanchion. A second socket can be positioned at an end of the second cross tube. The second socket can define a second opening for receiving the second stanchion. The first and second openings can be oriented transversely to the first and second tubes respectively. In a specific example embodiment, the first socket can be integrally formed with the first tube. Further by way of example, the second socket can be integrally formed with the second tube.

Further disclosed herein are various portable training kits, which include at least one training device disclosed herein and a carrying case.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

Figure 1:
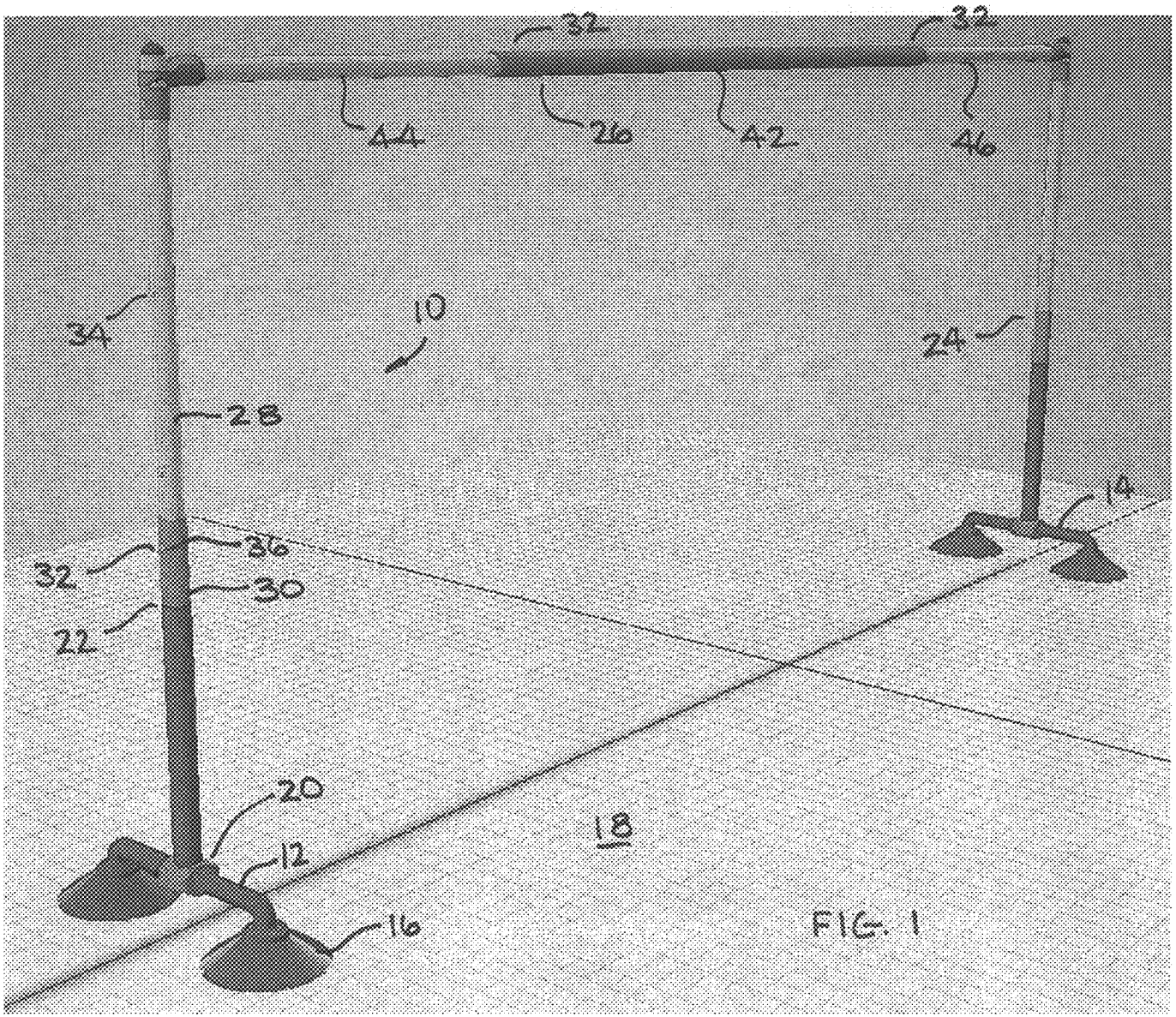
FIG. 1 is an isometric view of an exemplary embodiment of a training device, as disclosed herein.

Although the figures depict particular shapes and appearances of the components of the training devices disclosed herein, it is understood that, except as set forth herein, the specific shapes and appearances of the components of the training devices depicted in the accompanying figures are not required to achieve the disclosed functionality of the device components. Thus, it is understood that other shapes and appearances of the disclosed device components can be used to achieve the disclosed functionality of the device components.

DETAILED DESCRIPTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout. It is to be understood that this invention is not limited to the particular methodology and protocols described, as such may vary. It is also to be understood that the terminology used herein is for the purpose of describing particular embodiments only, and is not intended to limit the scope of the present invention.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

As used herein the singular forms "a", "an", and "the" include plural referents unless the context clearly dictates otherwise. Thus, for example, reference to "an attachment member" can include a plurality of such attachment members, and so forth. All technical and scientific terms used herein have the same meaning as commonly understood to one of ordinary skill in the art to which this invention belongs unless clearly indicated otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint. Optionally, in some aspects, when values are approximated by use of the antecedent "about," it is contemplated that values within up to 10% or up to 5% (above or below) of the particularly stated value can be included within the scope of those aspects. Similarly, in some optional aspects, when values are approximated by use of the term "substantially," it is contemplated that values within up to 15%, up to 10%, or up to 5% (above or below) of the particular value can be included within the scope of those aspects.

As used herein, the terms "optional" or "optionally" mean that the subsequently described event or circumstance may or may not occur, and that the description includes instances where said event or circumstance occurs and instances where it does not.

The word "or" as used herein means any one member of a particular list and also includes any combination of members of that list.

Disclosed herein, in various aspects and with reference to FIGS. 1-19, are training devices for developing and practicing various athletic skills, including ball handling skills. In exemplary aspects, the training device can be securable to a floor and comprise: a first base having at least one attachment member for attaching the first base to the floor; a first stanchion having a first end attached to the first base and a second end oppositely disposed, the first stanchion extending upwardly from the first base transversely to the floor; a second base having at least one attachment member for attaching the second base to the floor; a second stanchion having a first end attached to the second base and a second end oppositely disposed, the second stanchion extending upwardly from the second base transversely to the floor; and a crossbar extending between the second ends of the first and second stanchions, the crossbar having first and second ends oppositely disposed; a first connector mounted proximate to the second end of the first stanchion, the first connector having a first receptacle for receiving the first end of the crossbar; and a second connector mounted proximate to the second end of the second stanchion, the second connector having a second receptacle for receiving the second end of the crossbar. It is contemplated that the first and second connectors can comprise any connector that can be used to connect the described components to each other as described herein. In some aspects, the base of each of the first and second stanchions can have a single attachment member. Optionally, in other aspects, at least one of the first and second stanchions can have a base with a plurality of attachment members. For example, the first and/or second bases can have two attachment members. In these aspects, it is contemplated the at least one attachment member of the first and second bases can comprise any structure that is suitable for attaching the first and second bases to the floor. For example, suitable attachment members can comprise a suction cup, a vacuum cup, an adhesive, a clamp, a latch, a bolt, a screw, or combinations thereof. It is further contemplated that the attachment member of the first base can have be the same as or different than the attachment member of the second base. In further aspects, each of the first and second stanchions can comprise a first tube positioned coaxially within a second tube, the second tube being attached to the base, the crossbar being attached to the first tube, the first and second tubes being axially movable relatively to one another. For each of the first and second stanchions, a detent can be operable between the first and second tubes for fixing a length of the first and second stanchions. Optionally, in some aspects, each of the first and second stanchions can comprises a plurality of tubes positioned coaxially one within another, the plurality of tubes being movable relative to one another. For example, at least one of the first and second stanchions can comprise a first tube positioned coaxially within a second tube, the second tube being coaxially positioned within a third tube, the third tube being attached to the base, the crossbar being attached to the first tube. In these optional aspects, for each of the first and second stanchions, a detent can operable between each of the tubes for fixing a length of the first and second stanchions. In further aspects, the crossbar can comprise a first tube positioned coaxially within a second tube, the first and second tubes being axially movable relative to one another. In these aspects, a detent can be operable between the first and second tubes for fixing a length of the crossbar. Optionally, in other aspects, the crossbar can comprises a plurality of cross tubes positioned coaxially one within another, the cross tubes being movable relative to one another. In these optional aspects, a detent can be operable between each of the cross tubes for fixing a length of the crossbar.

In another exemplary aspect, the training device can be securable to a floor and comprise: a first attachment member attachable to the floor; a first tube having a first end and a second end oppositely disposed, the first tube extending transversely the floor; a first flexible element disposed between the first attachment member and the first end of the first tube; a second attachment member attachable to the floor; a second tube having a first end and a second end oppositely disposed, the second tube extending transversely to the floor; a second flexible element disposed between the second attachment member and the first end of the second tube, the first and second flexible elements each have bending stiffnesses less than a bending stiffness of the first and second tubes respectively; a crossbar extending between the second ends of the first and second tubes, the crossbar having first and second ends oppositely disposed; a first fitting having a first receptacle for receiving the second end of the first tube and a second receptacle for receiving the first end of the crossbar, the first and second receptacles of the first fitting being angularly oriented with respect to one another; and a second fitting having a first receptacle for receiving the second end of the second tube and a second receptacle for receiving the second end of the cross bar, the first and second receptacles of the second fitting being angularly oriented with respect to one another. In one aspect, the first and second flexible elements can comprise respective coil springs, elastomeric bodies, or both. In another aspect, the first tube can be coaxially received within the first receptacle of the first fitting and the second tube can be coaxially received within the first receptacle of the second fitting, the first tube being axially movable relatively to the first receptacle of the first fitting, and the second tube being axially movable relatively to the first receptacle of the second fitting. In further aspects, the training device can further comprise a first detent that can operable between the first tube and the first fitting; and a second detent that can be operable between the second tube and the second fitting, the first and second detents can be configured for fixing a height of the crossbar above the floor. In another aspect, the first end of the crossbar can be coaxially received within the second receptacle of the first fitting and the second end of the crossbar can be coaxially received within the second receptacle of the second fitting, the crossbar being axially movable relatively to the second receptacle of the first fitting and the second receptacle of the second fitting. In this aspect, the training device can comprise a first detent operable between the crossbar and the first fitting; and a second detent operable between the crossbar and the second fitting, the first and second detents can be configured for fixing a separation distance between the first and second tubes.

In another exemplary aspect, disclosed herein is a training device positionable on a floor. In this exemplary aspect, the training device can comprise: a first base comprising a first side and an opposed second side attached to one another by at least first and second legs oriented angularly with respect to the first and second sides of the first base, the first side adapted to engage the floor; a first stanchion extending from the first base transversely relative to the floor; a second base comprising a first side and a second side attached to one another by at least first and second legs oriented angularly with respect to the first and second sides of the second base, the first side of the second base adapted to engage the floor; a second stanchion extending from the second base transversely relative to the floor; and a crossbar extending from the first stanchion to the second stanchion, the crossbar being oriented transversely to the first side of at least one of the first and second bases. As further described herein, it is contemplated that the first and second base can comprise any shape that is suitable for achieving the intended purpose of the present disclosure, such as for example, a trapezoid, a rectangle, a square, a parallelogram, or the like. In some aspect, it is contemplated that, for each of the first and second bases, the first side can have a length that is greater than a length of the second side. In further aspects, at least one of the first and second bases can have a flexible, resilient layer positioned on the first side for engaging the floor. In these aspects, it is contemplated that the flexible, resilient layer can comprise a plurality of pads positioned in spaced relation to one another along the first side of the at least one base. Optionally, in some aspects, each of the first and second stanchions can comprise a plurality of tubes positioned coaxially one within another, and the tubes can be movable relative to one another. For example, and without limitation, at least one of the stanchions can comprise a first tube positioned coaxially within a second tube, the second tube being coaxially positioned within a third tube, the third tube being attached to the base, and the crossbar being attached to the first tube. In these aspects, for each the stanchion, a detent can be operable between each of the tubes for fixing a length of the first and second stanchions. In further optional aspects, the crossbar can comprise a plurality of cross tubes positioned coaxially one within another, and the cross tubes can be movable relative to one another. For example, the crossbar can comprise a first cross tube positioned coaxially within a second cross tube, and the first and second cross tubes can be axially movable relatively to one another. In this aspect, the training device can further comprise a detent operable between the first and second cross tubes for fixing a length of the crossbar. In another aspect, the crossbar can comprise: a first socket positioned at an end of the first cross tube, the first socket defining a first opening for receiving the first stanchion; and a second socket positioned at an end of the second cross tube, the second socket defining a second opening for receiving the second stanchion. In this aspect, the first and second openings can be oriented transversely to the first and second tubes, respectively. It is contemplated that, in some aspects, the first socket can be integrally formed with the first tube, and/or the second socket can be integrally formed with the second tube.

Figure 2:
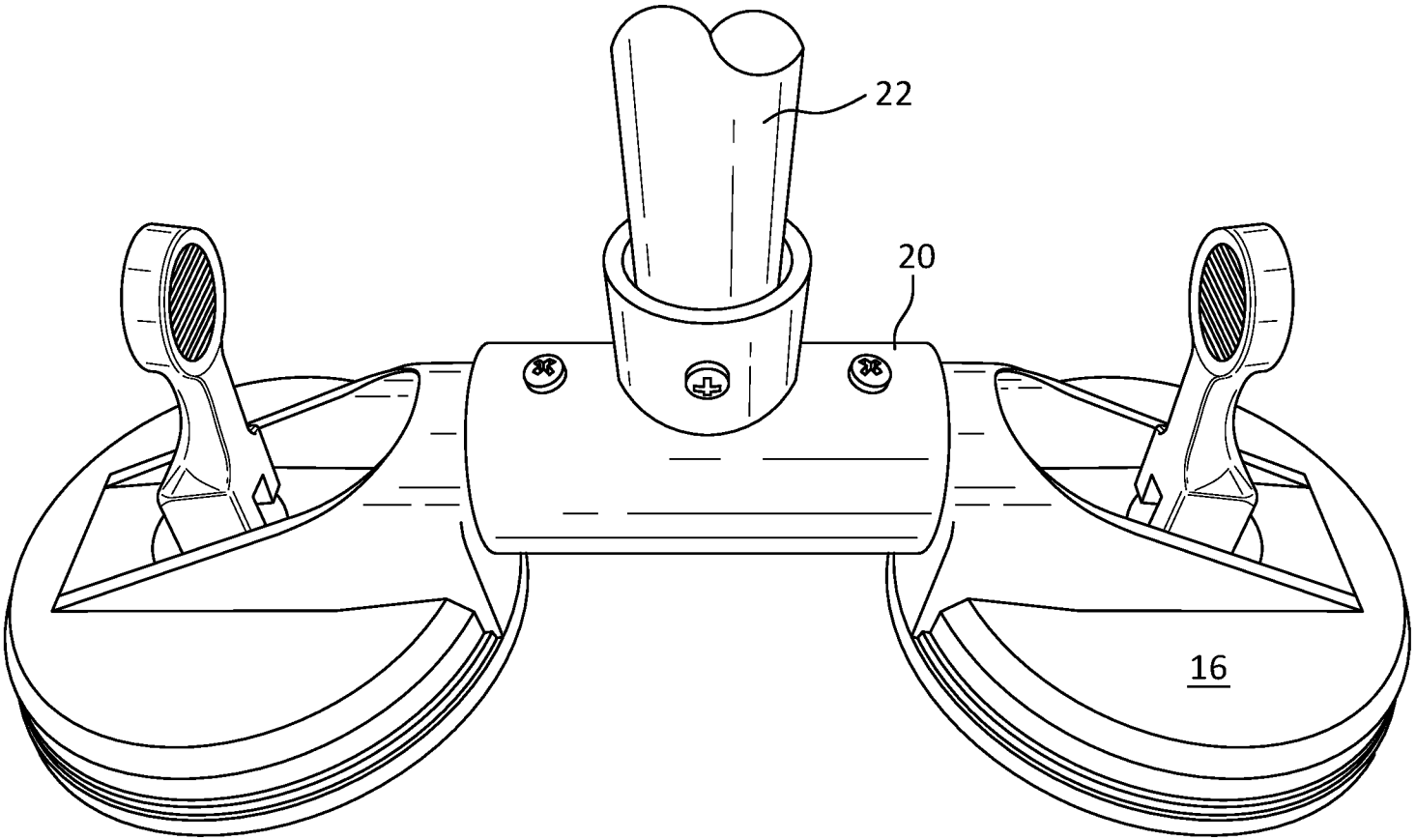
FIG. 2 is an isometric view of an exemplary attachment member having a cam and lever design, as disclosed herein.

Referring now to the figures, FIG. 1 shows an example embodiment of a training device 10 for developing and practicing ball handling skills for a sport, such as basketball. Device 10 comprises first and second bases, in this example, beams 12 and 14, each having at least one suction cup 16 for removably attaching each base to a smooth surface such as a gymnasium floor 18. The example embodiment 10 has two suction cups 16 mounted at opposite ends of each beam 12 and 14 to provide additional stability. Beams 12 and 14 can further comprise a "Tee" fitting 20 as shown in FIG. 2. As shown in FIG. 1, suction cups 16 can be simple conical membranes of flexible elastomeric material such as rubber, or, as shown in FIG. 2, the suction cups can be of the more sophisticated cam and lever design which allows easier attachment and detachment to and from the floor surface 18.

With reference again to FIG. 1, device 10 further comprises first and second stanchions 22 and 24. Stanchion 22 is attached to base 12 and stanchion 24 is attached to base 14. The attachment of the stanchions to their respective bases is conveniently accomplished using the Tee fittings 20, although other forms of attachment are of course feasible. In use, the stanchions 22 and 24 extend from their respective bases 12 and 14 transversely to the floor 18. A crossbar 26 extends from the first stanchion 22 to the second stanchion 24.

In the example embodiment shown in FIG. 1, the stanchions 22 and 24 comprise a first tube 28 positioned coaxially within a second tube 30. Each second tube 30 is attached to a respective base 12 and 14 and the crossbar 26 is attached to the first tubes 28. The first and second tubes 28 and 30 are axially movable relatively to one another to permit the height of the crossbar 26 above the floor 18 to be adjusted. It is advantageous to fix the length of stanchions 22 and 24 using a detent 32 operating between the first and second tubes 28 and 30. In the example embodiment shown in FIG. 1 the detent comprises a plurality of spring biased buttons 34 mounted in the first tubes 28 which engage a hole 36 in each of the second tubes 30. The buttons 34 are distributed in spaced relation along the length of the first tubes 28 and allow for adjustment of the length of the stanchions 22 and 24 (and thereby the height of the crossbar 26).

Figure 3:
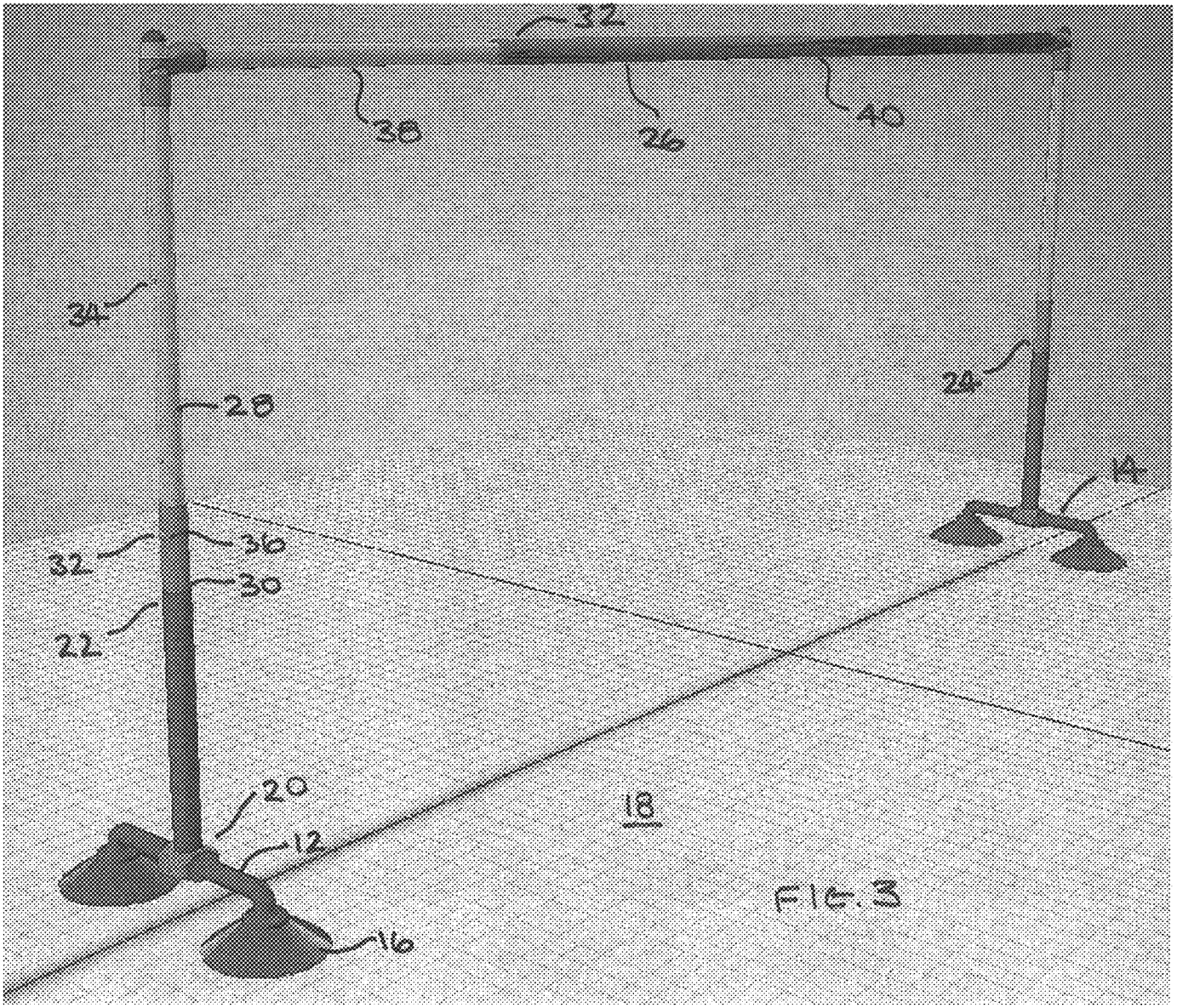
FIG. 3 is an isometric view of an exemplary embodiment of a training device, as disclosed herein.

In one example embodiment, shown in FIG. 3, crossbar 26 also comprises a first tube 38 positioned coaxially within a second tube 40. Tubes 38 and 40 are movable axially relatively to one another to permit adjustment of the length of the crossbar 26 and thereby establish the separation of the stanchions 22 and 24. A detent 32 can also operate between the tubes 38 and 40 to fix the length of the crossbar, yet allow for adjustability. The detent can comprise the biased button and hole arrangement as described for the tubes 28 and 30 comprising the stanchions 22 and 24. In another example embodiment shown in FIG. 1, the crossbar 26 comprises a sleeve 42 having a first tube 44 arranged coaxially within the sleeve, and extending from one end of the sleeve, and a second tube 46 arranged coaxially within the sleeve 42 and extending from the other end thereof. The tubes 44 and 46 are axially movable relatively to the sleeve 42 to permit adjustment of the length of the crossbar 26. Again, detents 32 can be used between the sleeve 42 and each of the tubes 44 and 46 to fix the length of the crossbar 26 yet allow adjustability.

Figure 4:
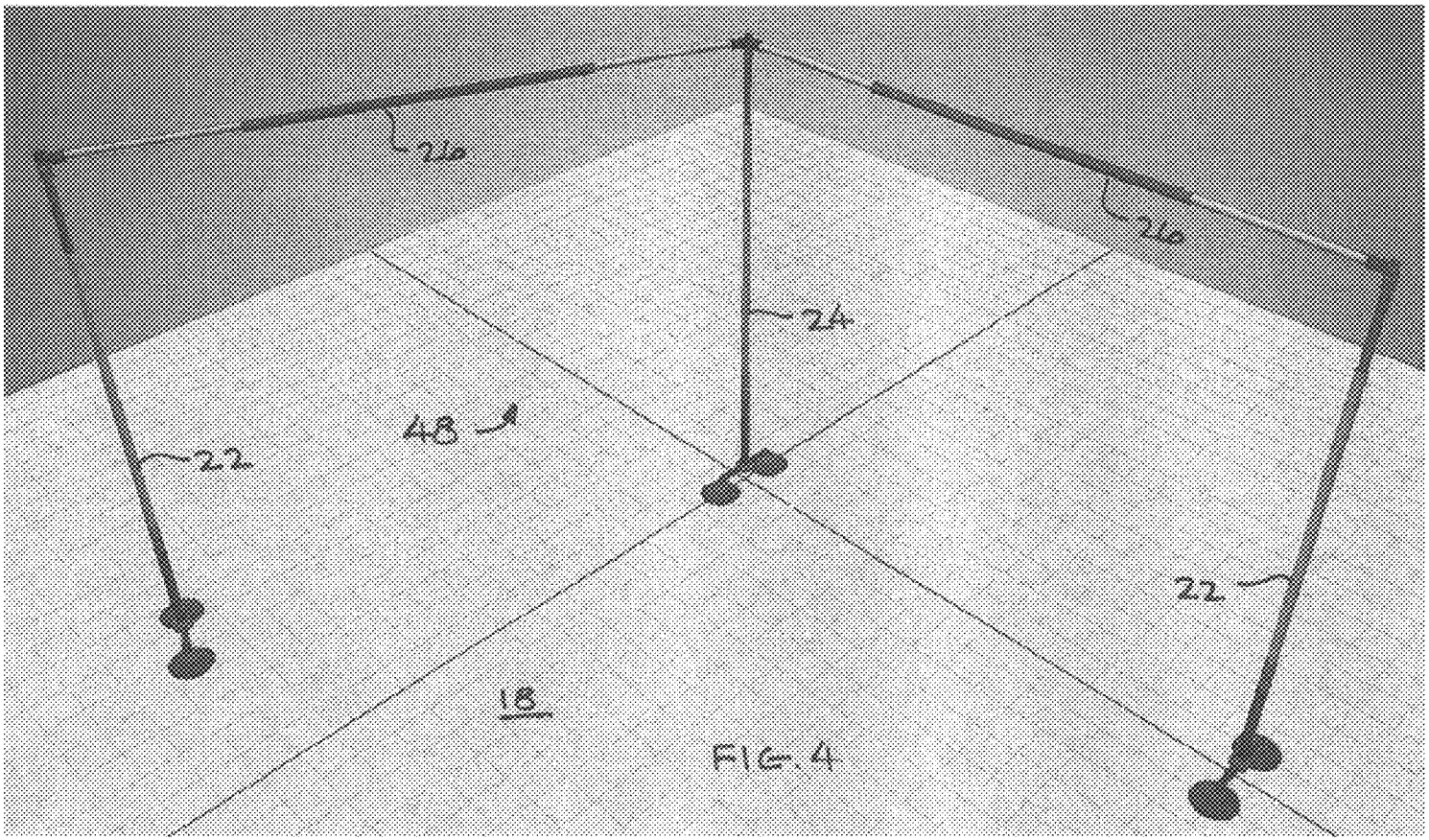
FIG. 4 is an isometric view of an exemplary assembly of training devices, as disclosed herein.
Figure 5:
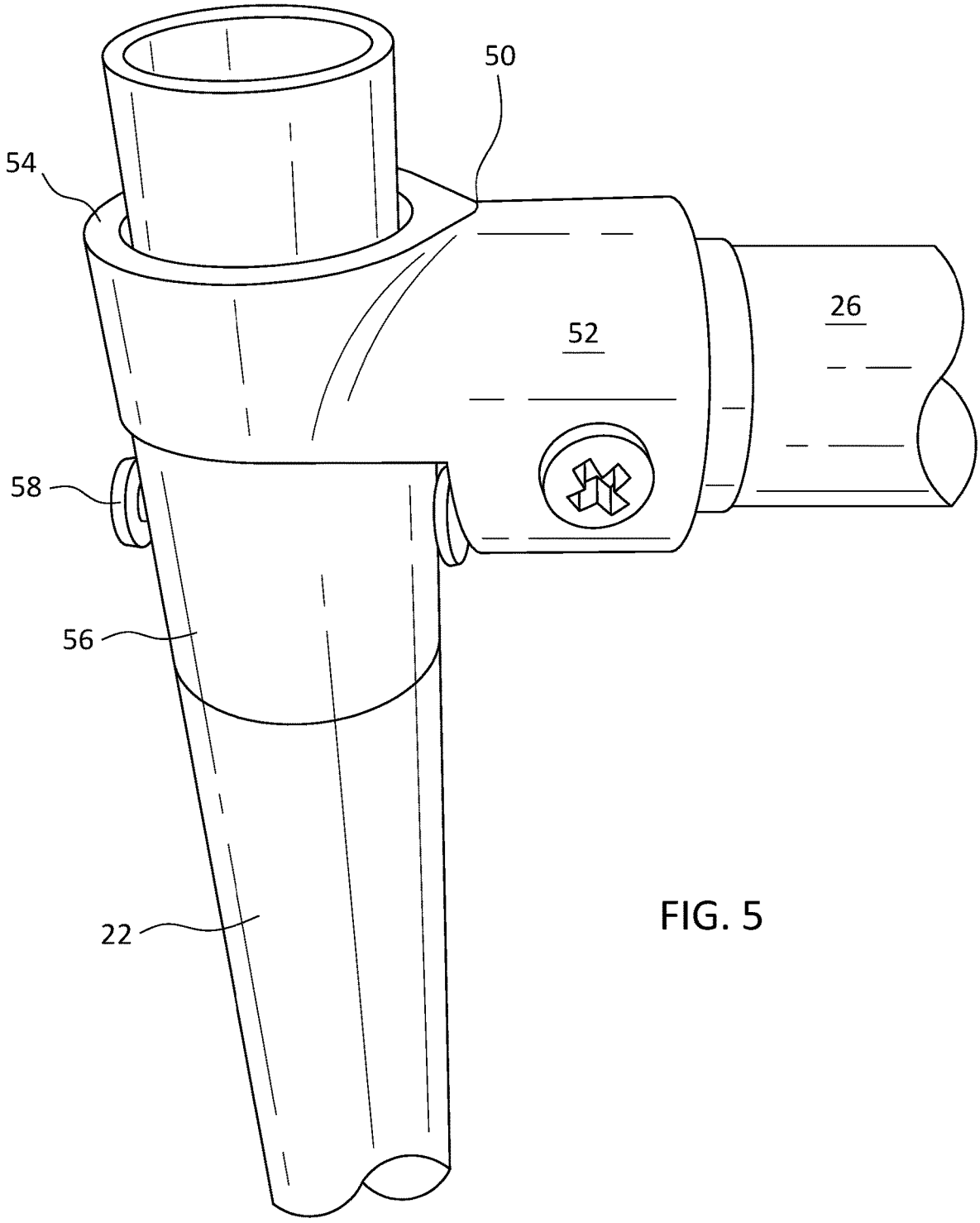
FIGS. 5 and 6 are isometric views of exemplary connectors for attaching together various components of the training device, as disclosed herein. The depicted connectors can be used with any embodiment of the training device disclosed herein, such as those shown in FIGS. 1 and 3.
Figure 6:
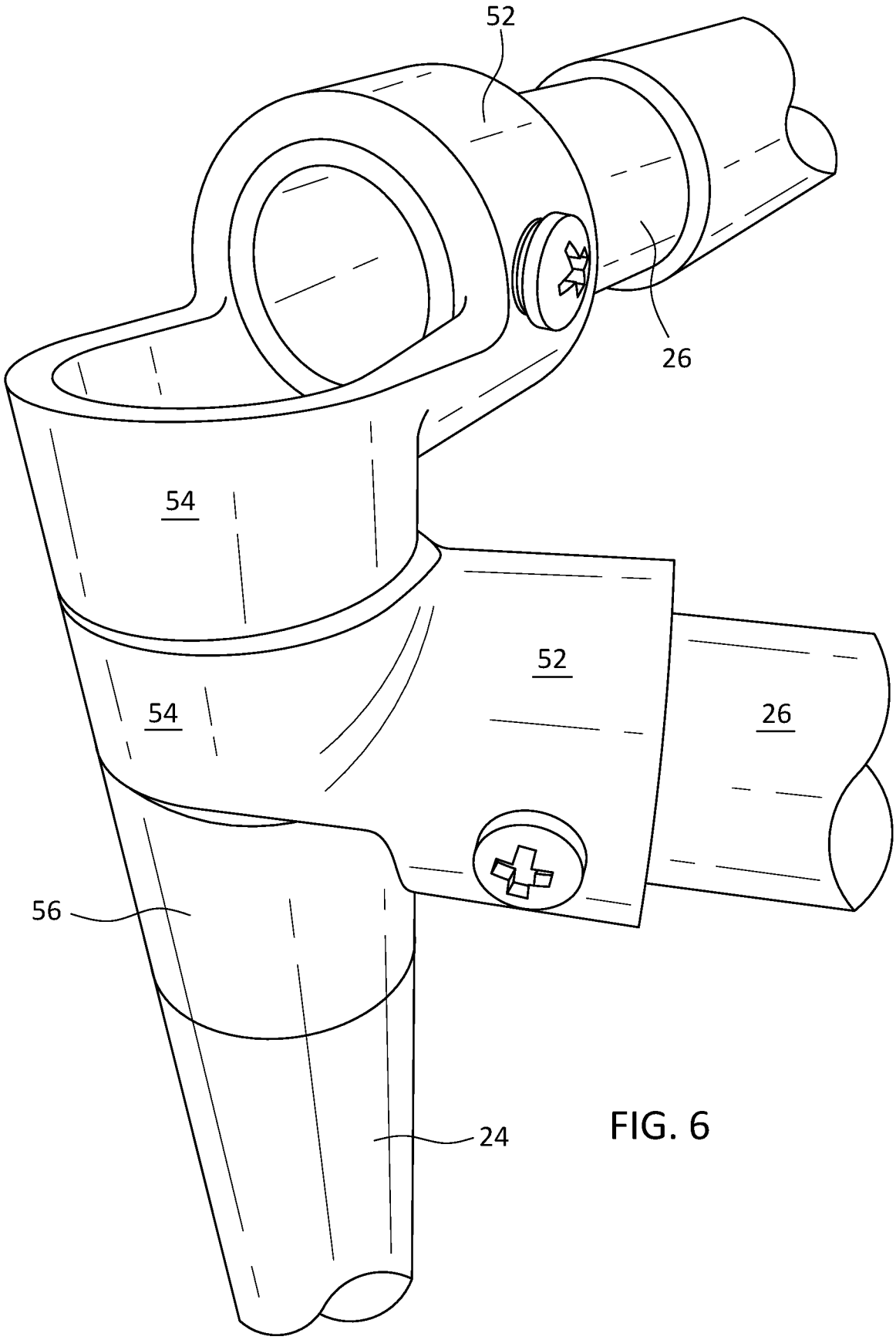

As shown in FIG. 4, multiple stanchions 22, 24, and crossbars 26 can be connected into an assembly 48 as desired for a particular training exercise. Connection of the crossbars 26 to the stanchions 22, 24 is effected via fittings 50 shown in FIGS. 5 and 6. In this example embodiment, a fitting 50 comprises a socket 52 which receives an end of crossbar 26. A lug 54 extends from the socket. Lug 54 receives a stanchion 22 or 24. The position of the fitting 50 on the stanchion 22 or 24 is determined by a collar 56 which is mounted on each stanchion distal to the respective base 12, 14 of each stanchion. The position of collar 56 can be adjustably fixed, for example, using a set screw 58. FIG. 6 shows the advantage obtained by the use of lugs 54 on the stanchions 22 and 24, as the lugs allow multiple crossbars 26 to be supported by a single stanchion 24, for example, to create the assembly 48 shown in FIG. 4. While FIG. 4 depicts a specific embodiment of the training device as having a plurality of such devices connected to each other to form the above-described assembly, it is to be understood that an assembly of training devices can be formed using any of the various components disclosed herein. It is also contemplated that any number of stanchions, tubes, and crossbars can be used to form such training assemblies as desired.

Figure 7:
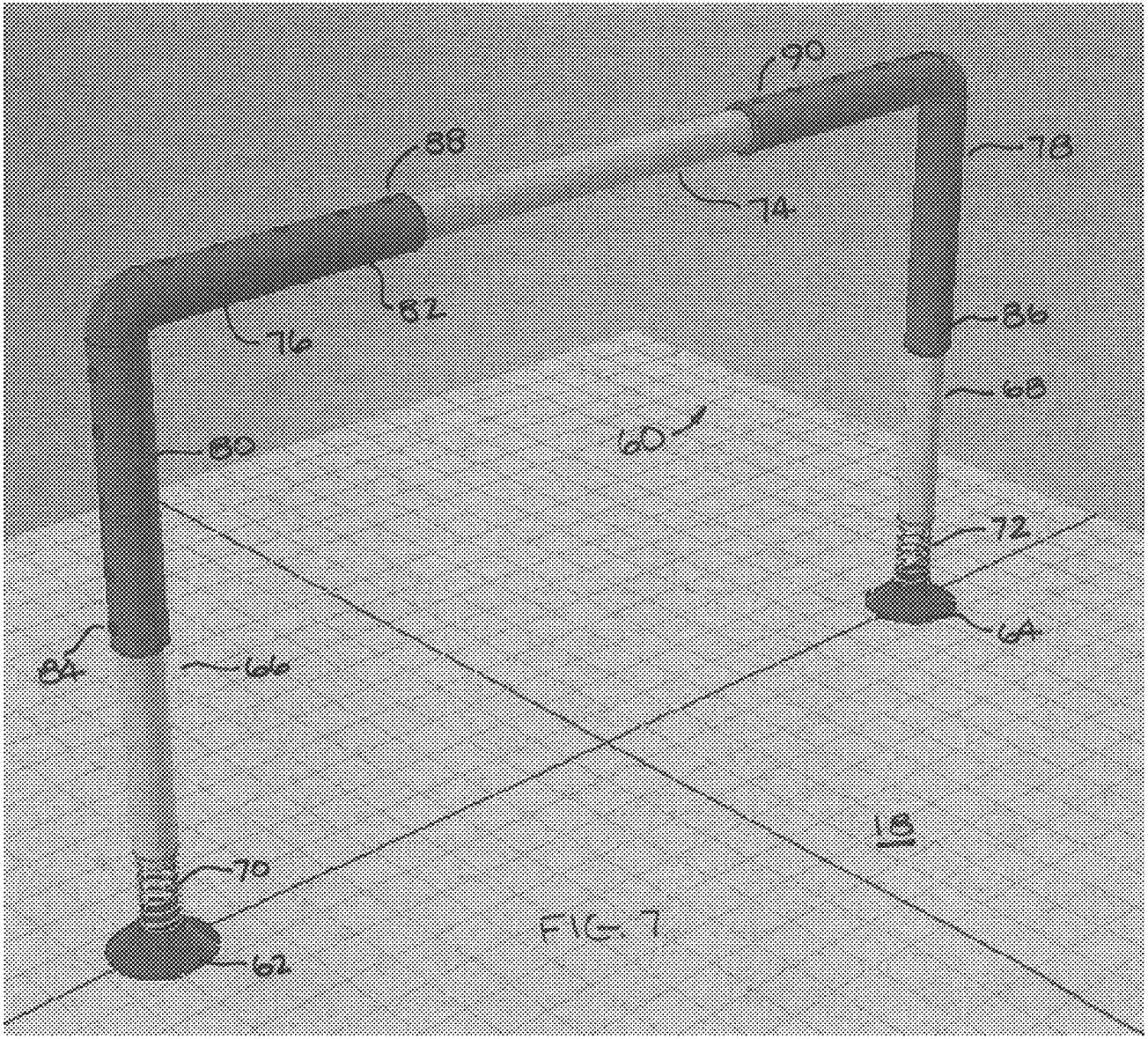
FIG. 7 is an isometric view of an exemplary embodiment of a training device, as disclosed herein.
Figure 8:
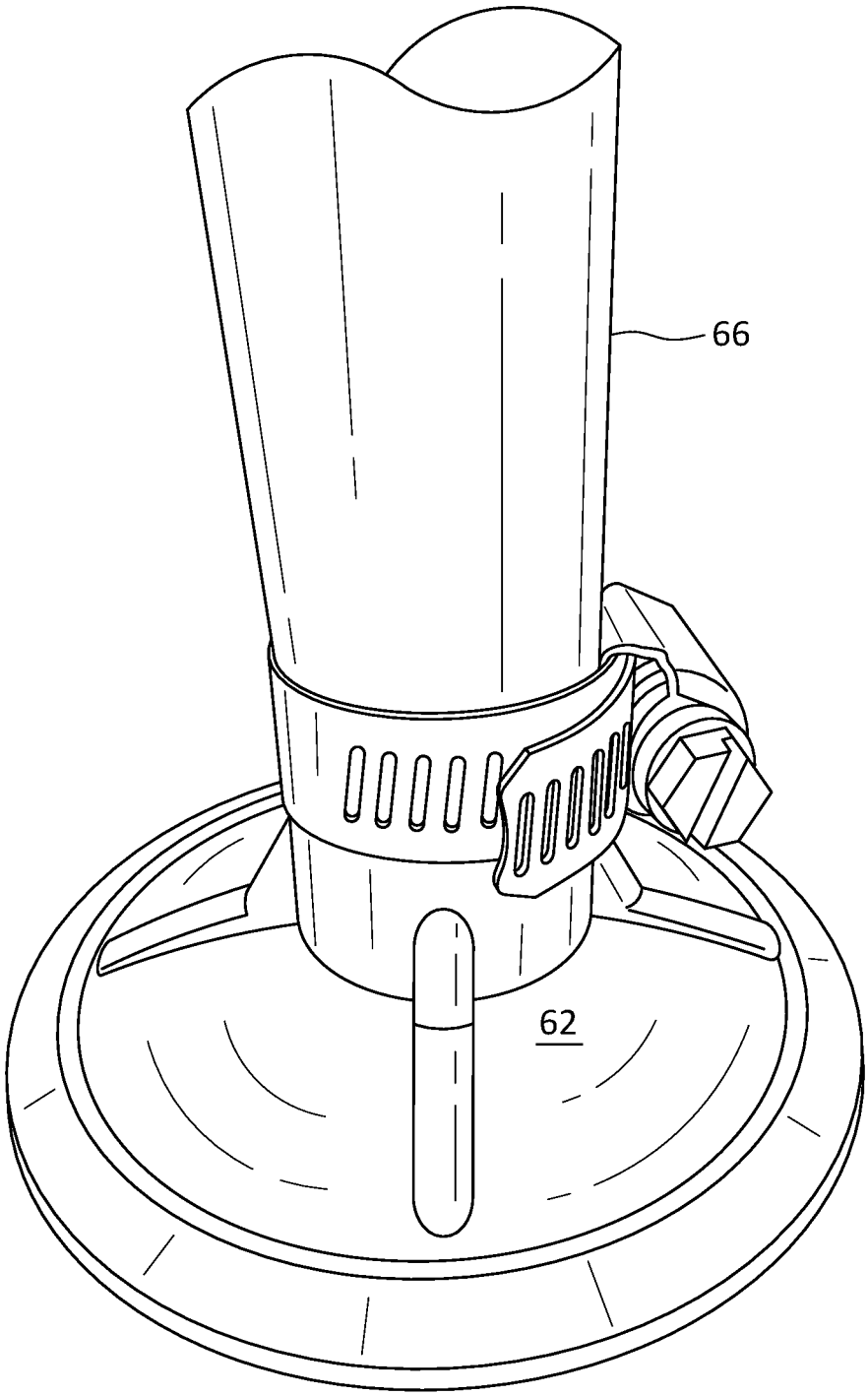
FIG. 8 is an isometric view of an exemplary attachment member usable with any embodiment of the training device as disclosed herein, such as the device shown in FIG. 7.

Another embodiment of an example training device 60 is shown in FIG. 7. Device 60 comprises first and second suction cups 62 and 64 attachable to the floor 18. A first stanchion 66 extends from the first suction cup 62 and a second stanchion 68 extends from the second suction cup 64. The stanchions 66 and 68 can be attached directly to the suction cups 62 and 64 as shown in FIG. 8, or, as shown in FIG. 7, first and second flexible elements 70 and 72 can be attached, respectively, to the suction cups 62 and 64. In this example embodiment, the first and second stanchions 66 and 68 extend, respectively, from the first and second flexible elements 70 and 72. The flexible elements 70 and 72 each have a bending stiffness less than the bending stiffnesses of the stanchions 66 and 68. The flexibility of the stanchions afforded by the flexible elements positioned between the suction cups 62 and 64 and the stanchions 66 and 68 respectively, help prevent injury of a player during practice by allowing the device 60 to bend out of the way in the event of contact between the player and the device. The flexible elements 70 and 72 can comprise, for example, coil springs (shown) or an elastomeric body, such as a rubber block to which a suction cup and stanchion are attached.

As shown in FIG. 7, a crossbar 74 extends from the first stanchion 66 to the second stanchion 68. In this example embodiment the crossbar 74 is attached to the stanchions 66 and 68 by first and second fittings 76 and 78. Each fitting comprises first and second receptacles 80 and 82. The receptacles are angularly oriented with respect to one another. In this example the orientation angle is 90° and the fittings 76, 78 form elbow joints. First receptacles 80 of each fitting 76, 78 receive a respective stanchion 66 or 68, and the second receptacles 82 receive an end of the crossbar 74. The stanchions 66 and 68 in this example comprise respective first and second tubes which are coaxially received within the first receptacles 80 on respective fittings 76 and 78. The tubes comprising stanchions 66 and 68 are axially movable with respect to their respective receptacles in which they are received. This permits adjustment of the height of the crossbar 74 above floor 18. First and second detents 84 and 86 operate respectively between the first stanchion and the first receptacle and the second stanchion and the second receptacle to adjustably fix the height of the crossbar 74. As further shown in FIG. 7, the crossbar 74 can also comprise a tube coaxially received within the second receptacles 82 of each fitting 76 and 78. The crossbar 74 is axially movable relatively to the receptacles 82 of each fitting for adjusting the separation of stanchions 66 and 68. Again, to adjustably fix the separation distance first and second detents 88 and 90 can operate between the crossbar 74 and the fittings 76 and 78.

Figure 9:
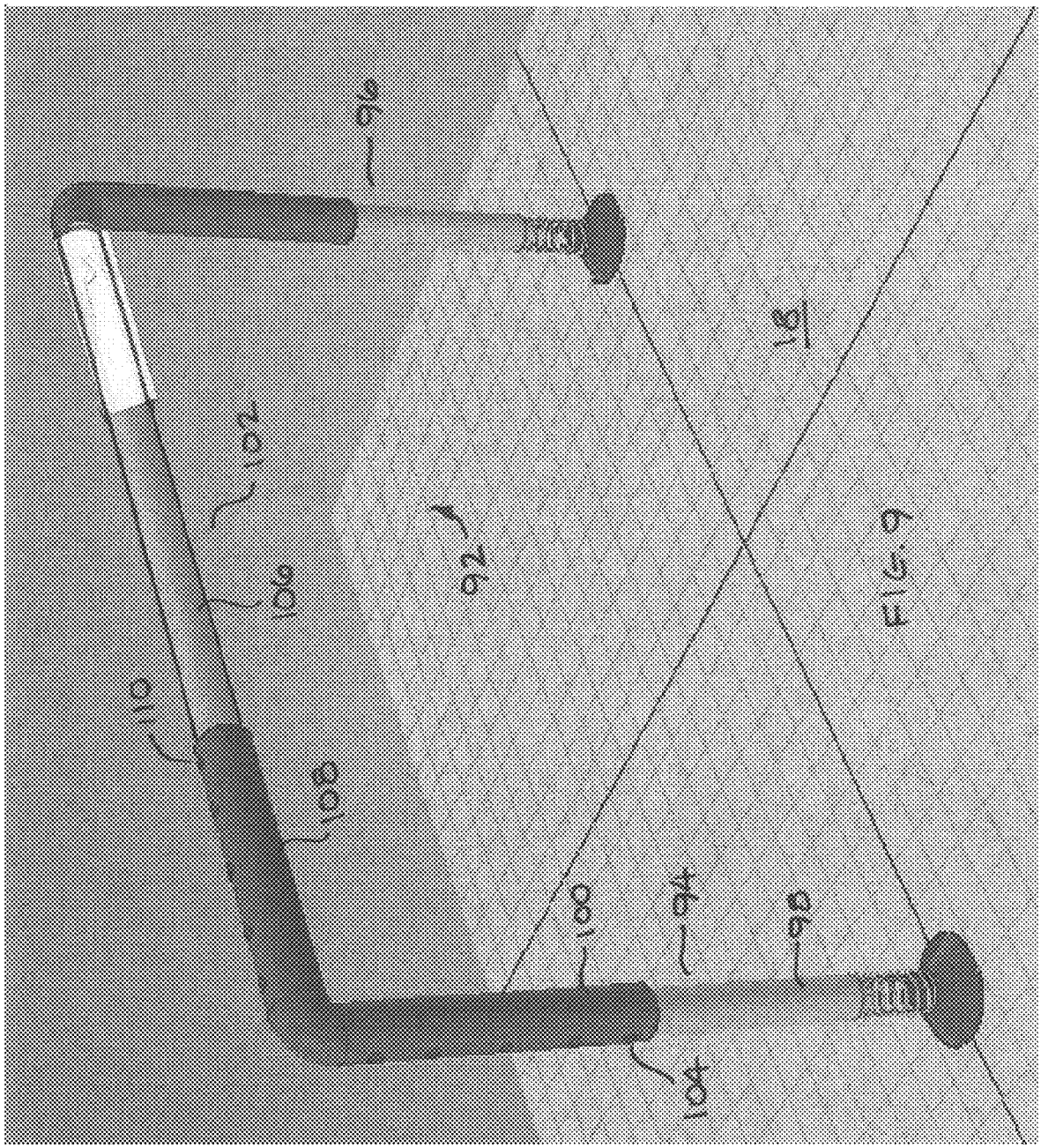
FIG. 9 is an isometric view of another exemplary embodiment of a training device, as disclosed herein.

In an alternate embodiment 92 shown in FIG. 9, each of the first and second stanchions 94 and 96 can comprise a first tube 98 coaxially positioned within a second tube 100. The first and second tubes 94 and 96 are movable with respect to one another for establishing the height of the crossbar 102 above floor 18. Again, detents 104 can operate between the first and second tubes 94 and 96 to adjustably fix the relative positions of the tubes. Similarly, crossbar 102 can comprise a first tube 106 positioned coaxially within a second tube 108. Tubes 106 and 108 are axially movable relatively to one another and a detent 110 can operate between the tubes 106 and 108 to adjustably fix their relative positions.

Figure 15:
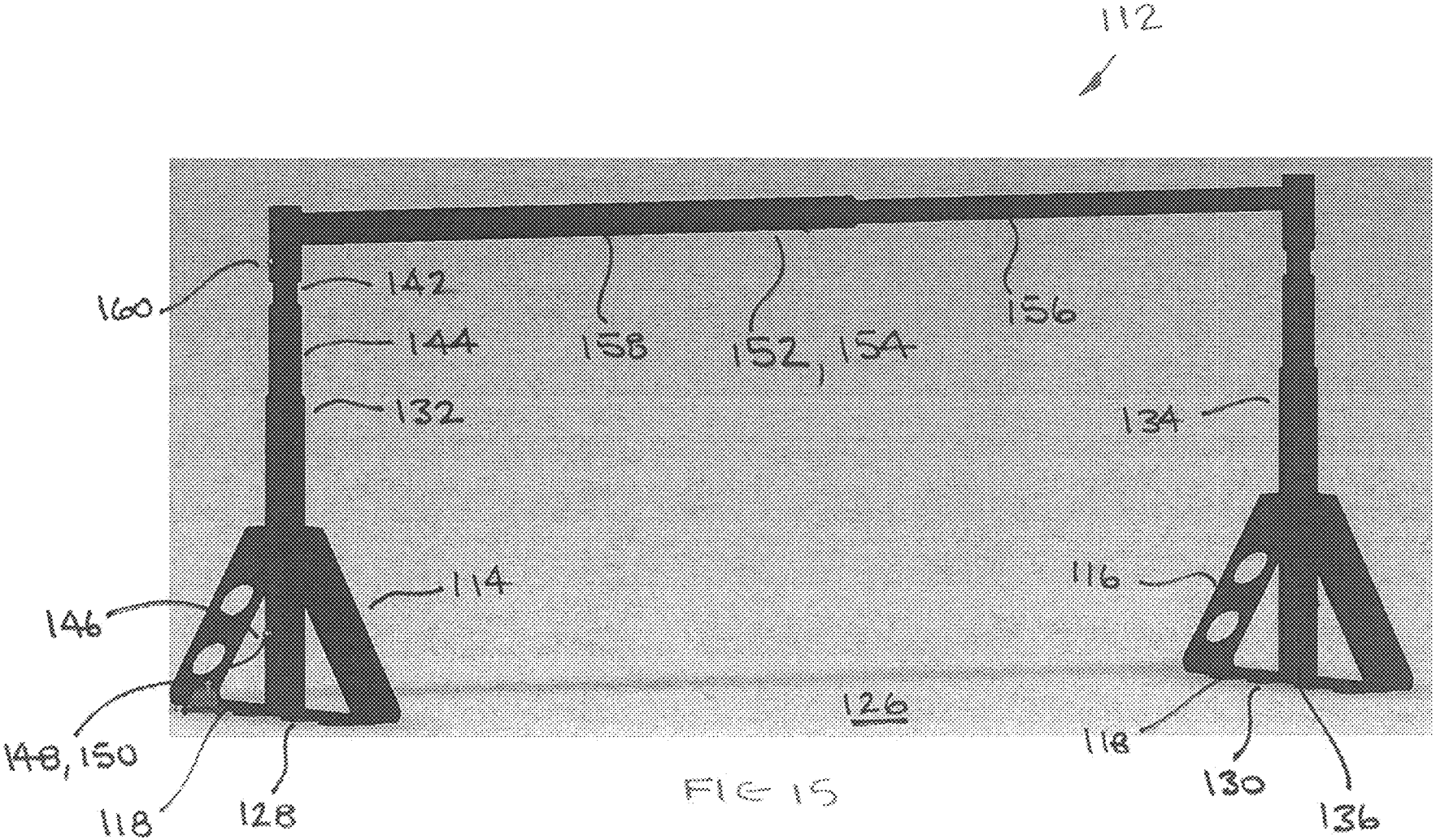
FIG. 15 is an isometric view of another exemplary embodiment of a training device, as disclosed herein.
Figure 16:
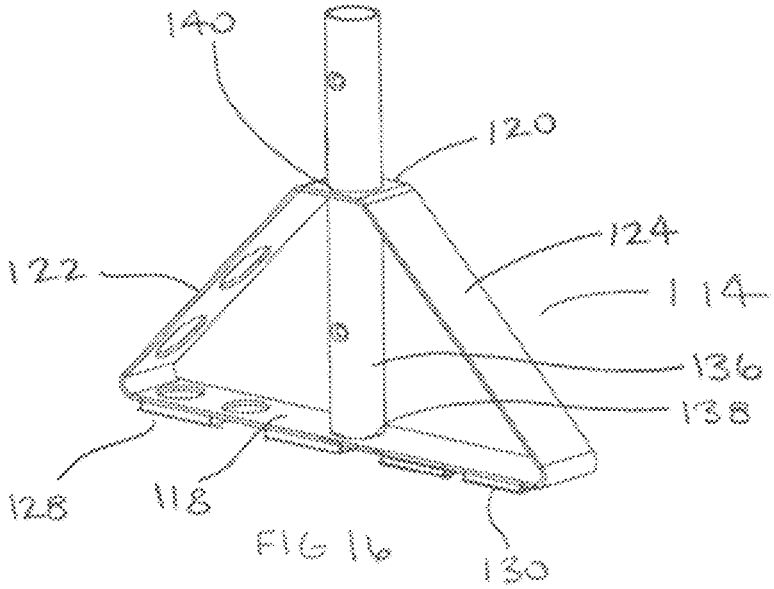
FIG. 16 is an isometric view of an exemplary base having a tube or stanchion engaging a first side of the base and extending through an opening of the second side of the base, as disclosed herein. The depicted base can be used with any of the disclosed embodiments of the training device disclosed herein, such as the device shown in FIG. 15.
Figure 17:
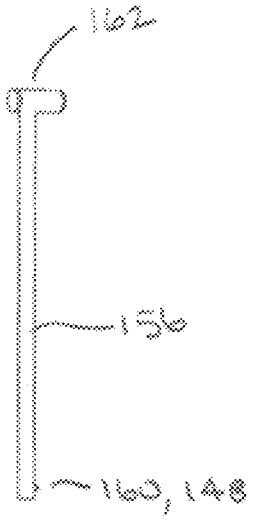
FIGS. 17 and 18 are isometric view of exemplary first and second cross tubes, respectively, as disclosed herein.
Figure 18:
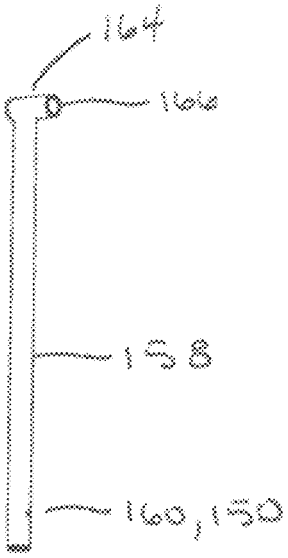

FIG. 15 shows another example embodiment of a training device 112 according to the invention. Device 112 comprises first and second trapezoidal bases 114 and 116. As shown in FIG. 16, each base 114 and 116 (114 shown) comprises a long side 118 and a short side 120. The long and short sides are attached to one another by first and second legs 122, 124. Legs 122 and 124 are oriented angularly with respect to the long and short sides 118 and 120 to give the bases 114 and 116 their characteristic trapezoidal shape. Bases 114 and 116 can be a molded polymer or formed from bent sheet metal, for example, steel. The long sides 118 of each base are adapted to engage the floor 126 (see FIG. 15) thereby providing stability to the device 112. A layer of flexible, resilient material 128 is positioned on long sides 118. The layer 128 can be formed, for example, of EPDM or other rubber compounds and provides purchase between the bases 114 and 116 and the floor 126. Layer 128 can be a continuous layer, co-molded on the base, or, as shown in FIGS. 15 and 16, the resilient layer can comprise a plurality of pads 130 positioned along the long sides 118 in spaced relation to one another.

First and second stanchions 132 and 134 extend, respectively from the first and second bases 114 and 116. In the example embodiment shown in FIG. 16, each stanchion comprises a tube 136 having an end 138 which engages the long side 118 of the base, the tube passing through an opening 140 in the short side 120. It is advantageous to attach the tubes 136 to the bases 114 and 116. This can be accomplished by welding or brazing the tube end 138 to the long side 118 and another portion of the tube to the short side 120 when the tubes and bases are formed of metal. Sonic welding can be used to attach polymer tubes to polymer bases.

Figure 19:
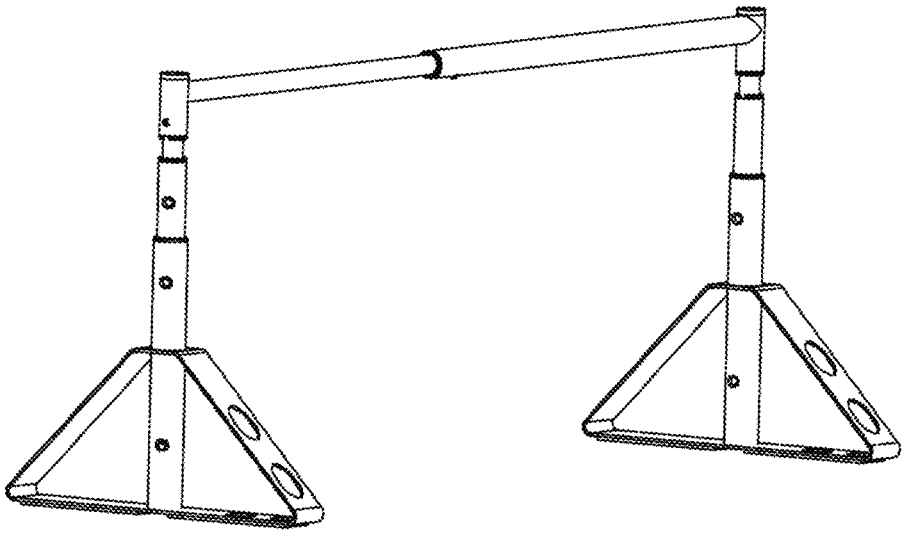
FIGS. 19 and 20 are isometric views of exemplary training devices as disclosed herein. The training device shown in FIG. 19 has a shorter adjusted height of each of the first and second stanchions and a greater adjusted length of the crossbar than that of the heights and length of the respective components of the training device shown in FIG. 20.
Figure 20:
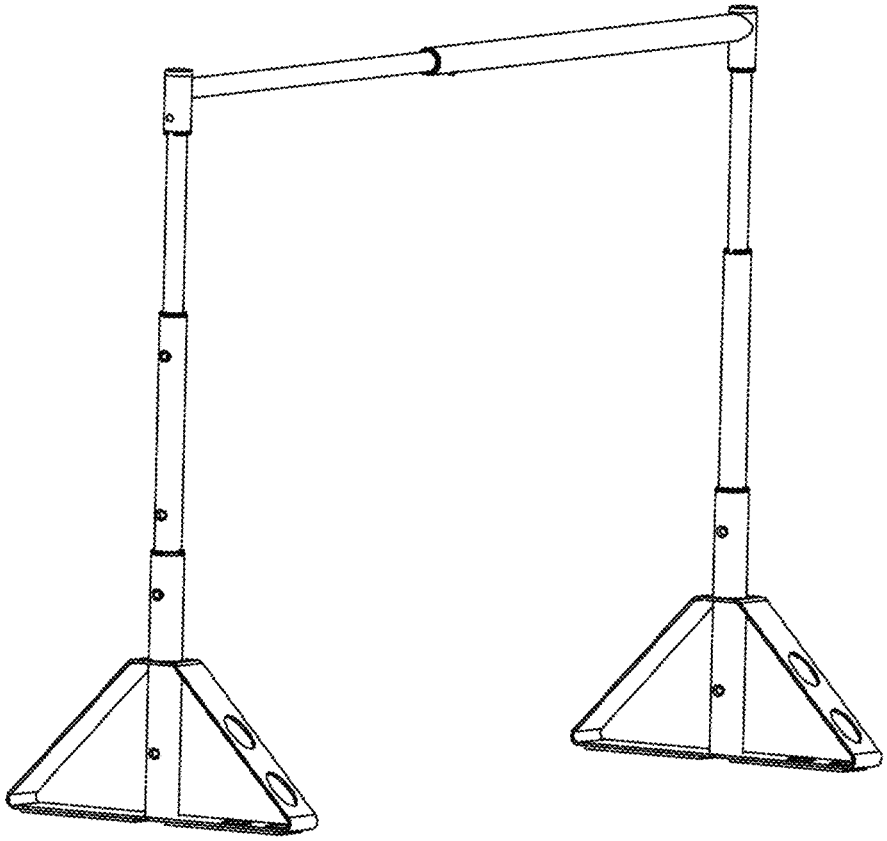

As shown in FIG. 15, stanchions 132 and 134 comprise a plurality of tubes positioned coaxially within and movable relatively to one another. In the example shown, a first tube 142 is positioned coaxially within a second tube 144, which is coaxially positioned within a third tube 136 which is attached to the base 114 and 116. The tubes are movable relative to one another in "telescoping" fashion and can use friction to hold the tubes in position relative to one another. However, detents 146 can operate between the tubes 142, 144 and 136 to provide positive mechanical engagement and hold the tubes in position. Detents can comprise spring biased buttons 148 mounted in some of the tubes, the button engaging a hole 150 in a mating tube. The buttons 148 are distributed in spaced relation along the length of the tubes and allow for adjustment of the length of the stanchions 132 and 134 and thereby the height of the crossbar 152 above the floor 126. With reference to FIGS. 19 and 20, the training device shown in FIG. 19 has a shorter adjusted height of each of the first and second stanchions and a greater adjusted length of the crossbar than the heights and length of the respective components of the training device shown in FIG. 20.

As shown in FIG. 15, crossbar 152 extends between stanchions 132 and 134. To provide stability to the device 112, the cross bar 152 is oriented transversely to the long side 118 of at least one of the bases 114 or 116. In this example, the crossbar 152 is oriented transversely to the long side of both bases. Crossbar 152 is formed of a plurality of cross tubes 154 positioned coaxially within one another. In the example embodiment shown in FIGS. 15, 17 and 18, crossbar 152 comprises first and second cross tubes 156 and 158. Cross tubes 156 and 158 are movable relatively to one another and can use friction to set and hold the length of the crossbar 152. A detent 160 can also be used to provide positive mechanical engagement to fix the crossbar length. Detent 160 can comprise a spring biased button 148 mounted the first cross tube 156, the button engaging a hole 150 in the second cross tube 158.

For mounting crossbar 152 on stanchions 132 and 134, a first socket 162 is positioned at an end of the first cross tube 156 and a second socket 164 is positioned at an end of the second cross tube 158. Each socket has an opening 166 oriented transversely to a respective cross tube 156 or 158. The sockets 162 and 164 are sized to receive the first tubes 142 of respective stanchions 132 and 134. The tubes 142 can be retained within the sockets 162 and 164 by friction, for example, or using detents 160 for a positive mechanical engagement. In this example embodiment the sockets 162 and 164 are integrally formed with their respective cross tubes 156 and 158.

Figure 10:
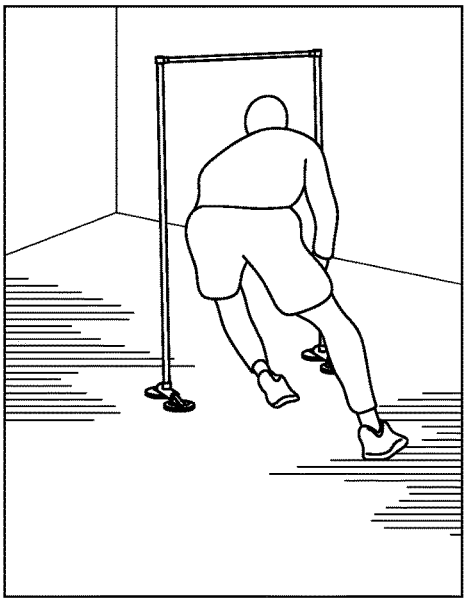
FIGS. 10-14 are various photographic images showing exemplary training devices in use, as disclosed herein.
Figure 11:
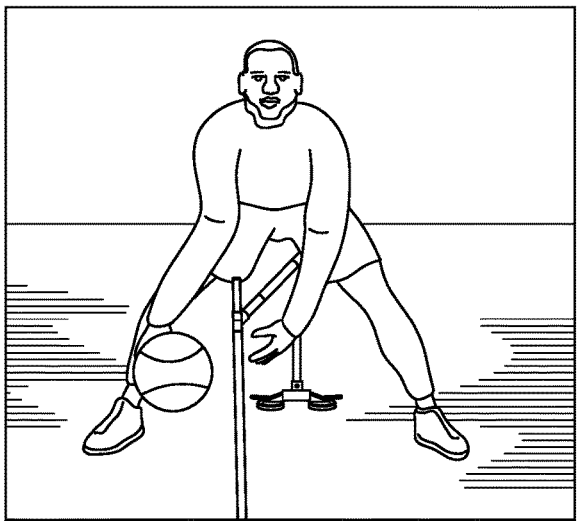
Figure 12:
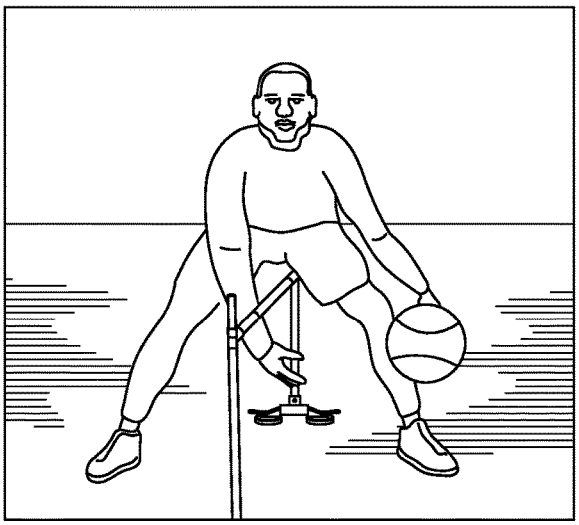
Figure 13:
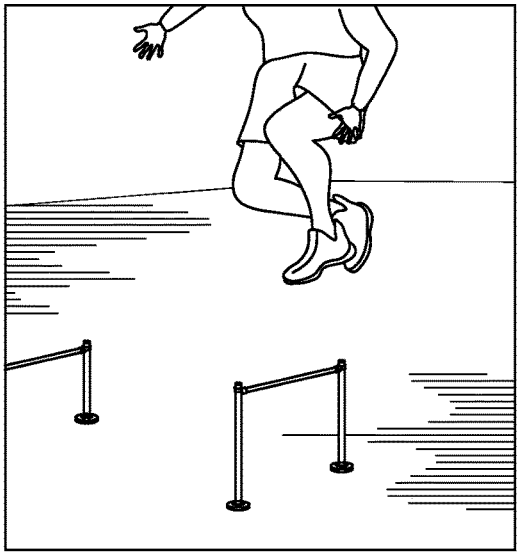
Figure 14:
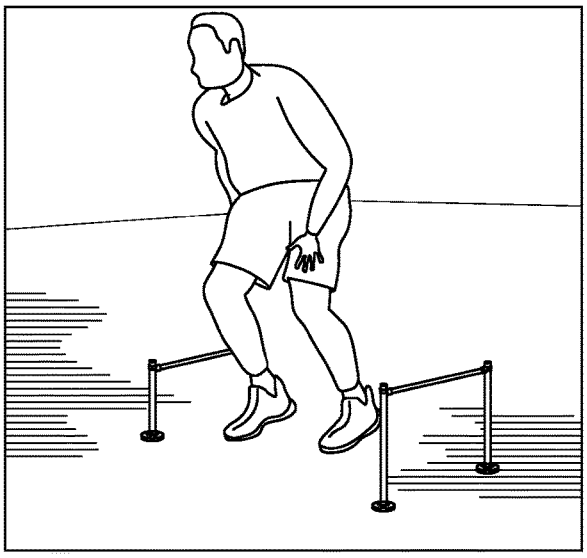

FIG. 10 shows device 10 in use for practicing the low dribble, the player moving between stanchions and beneath the crossbar, which has a height set to force the player into a low crouch. FIGS. 11 and 12 show a player practicing ball handling by straddling device 10 and passing the ball between hands. FIGS. 13 and 14 show a player using device 60 in an agility drill. It is understood that device 112 would be used in a similar fashion as shown for device 10. The advantage obtained by the use of flexible elements 70 and 72 to connect stanchions 66 and 68 to the suction cups 62 and 64 (see FIG. 7) is apparent, as a less than flexible device might trip and injure the player. Similarly for device 112, the purchase between the flexible, resilient layer 128 and the floor 126 provides enough adhesion between the bases 114 and 116 and the floor to permit some contact between the device 112 and a player so that the device remains upright, but while avoiding the danger of potential injury to a player which might otherwise ensue if the device were rigidly fixed to the floor.

Figure 21:
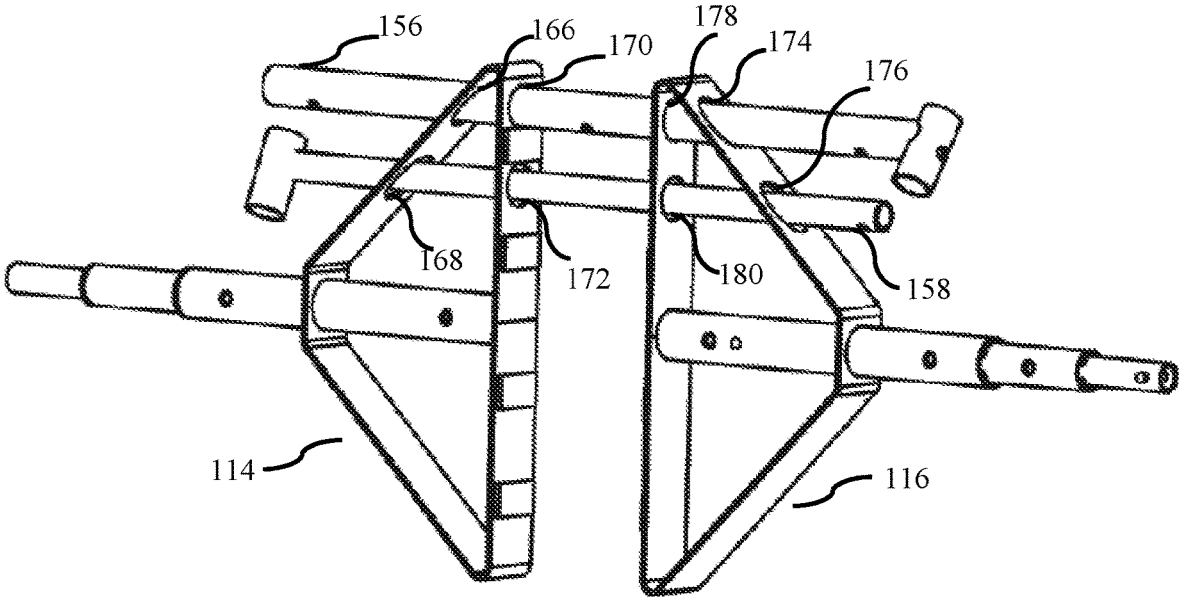
FIG. 21 is an isometric view of an exemplary embodiment of the training device, showing the components being at least partially disassembled from one another.

In further exemplary aspects, it is contemplated that one or more of the individual components of the training devices disclosed herein can be provided in the form of a portable training kit. In particular, the portable training kit can include any embodiment of the disclosed training devices and a carrying case. In these aspects, the portable training kit can include the disclosed bases, stanchions, tubes, pads, connectors, attachment members, fittings, crossbars, cross tubes, sleeves, detents, and/or any other components of the training devices disclosed herein. It is contemplated that the disclosed components of the training devices can be provided inside the kit as unassembled components, pre-assembled components, or a combination of both. For example, it is contemplated that the kit can comprise first and second bases that are pre-assembled to the first and second stanchions, respectively, whereas the cross tubes of the crossbar can be provided as individual, unassembled components, as shown in FIG. 21. For purposes of compact packaging and storage and/or ease of transport, it is contemplated that the first and second bases 114, 116 of the disclosed training device each can have respective first holes 166, 174, second holes 168, 176, third holes 170, 178, and fourth holes 172, 180. As shown in FIG. 21, within each base 114, 116, the first and second holes 166/168 or 174/176 can be defined within a leg 122, 124 of the base, while the third and fourth holes 170/172 or 178/180 can be defined within the long side 118 of the base. The first and third holes 166/170 and/or 174/178 can be aligned with one another and the second and fourth holes 168/172 and/or 176/180 can be aligned with one another, with the combination of the first and third holes and the combination of the second and fourth holes being arranged, respectively, for receiving opposite ends of the first and second crossbars 156 and 158 (shown in FIG. 21) or stanchions.

In further exemplary aspects, it is contemplated that the kit can further comprise a carrying case (e.g., a bag) for holding the training device. Optionally, the carrying case can comprise a vinyl or cloth material. It is contemplated that the carrying case can enclose the components of the training device. In these aspects, the components of the training device can be stacked and placed inside of the carrying case. Optionally, the carrying case can comprise a fastener configured to secure the components of the training device inside the carrying case. Exemplary fasteners can include a zipper, a button, a hook and loop fastener, a snap, a press stud, a snap button, an inter-locking connecting shape, or combinations thereof. In these aspects, the carrying case can be selectively opened to give access to the components of the training device. In further aspects, the kit can comprise a product package. In these aspects, it is contemplated that the carrying case can be packaged inside of the product package. In these aspects, the product package can be selectively opened to give access to the carrying case. Optionally, in some aspects, the kit can comprise instructions for assembling the components of the training device as described herein. It is further contemplated that the respective components of the training device described herein can be labeled to indicate the particular sizing and/or attachment features that enable a user of the training device to assemble the components to each other.

It is contemplated that the disclosed training devices and kits can offer several advantages to users. For instance, the detachability of the respective components of the training devices from each other can permit a user to disassemble the components for easy transport from one place to another, or to simply use less space for storage.

It is expected that the use of training devices according to the invention will markedly improve certain athletic abilities and skills such as, ball handling, ball placement, efficiency, agility, stretching, muscle endurance, and more. It is further contemplated that the training devices of the present disclosure can be used by individuals at various skill levels for any sport that involves techniques ball handling and/or rapid, tactical movements, such as basketball, soccer, and football.

EXEMPLARY ASPECTS

In view of the described training devices and variations thereof, herein below are described certain more particularly described aspects of the invention. These particularly recited aspects should not, however, be interpreted to have any limiting effect on any different claims containing different or more general teachings described herein, or that the "particular" aspects are somehow limited in some way other than the inherent meanings of the language literally used.

Aspect 1: A training device securable to a floor, said training device comprising: a first base having at least one suction cup for attaching said first base to said floor; a first stanchion extending from said first base transversely to said floor; a second base having at least one suction cup for attaching said second base to said floor; a second stanchion extending from said second base transversely to said floor; a crossbar extending from said first stanchion to said second stanchion.

Aspect 2: The training device according to aspect 1, wherein each one of said first and second bases has two suction cups for attaching said first and second bases to said floor.

Aspect 3: The training device according to any one of the preceding aspects, wherein each of said first and second stanchions comprise a first tube positioned coaxially within a second tube, said second tube being attached to said base, said cross bar being attached to said first tube, said first and second tubes being axially movable relatively to one another.

Aspect 4: The training device according to aspect 3, further comprising, for each said stanchion, a detent operating between said first and second tubes for fixing a length of said first and second stanchions.

Aspect 5: The training device according to any one of the preceding aspects, wherein said crossbar comprises a first tube positioned coaxially within a second tube, said first and second tubes being axially movable relatively to one another.

Aspect 6: The training device according to aspect 5, further comprising a detent operating between said first and second tubes for fixing a length of said crossbar.

Aspect 7: The training device according to any one of the preceding aspects, wherein said crossbar comprises: a sleeve; a first tube arranged coaxially within said sleeve and extending from one end thereof; a second tube arranged coaxially within said sleeve and extending from another end thereof, said first and second tubes being axially movable relatively to said sleeve.

Aspect 8: The training device according to aspect 7, further comprising: a first detent operating between said sleeve and said first tube; a second detent operating between said sleeve and said second tube, said detents for fixing a length of said crossbar.

Aspect 9: The training device according to any one of the preceding aspects, further comprising: a first collar mounted on said first stanchion distal to said first base; a second collar mounted on said second stanchion distal to said second base; a first socket receiving a first end of said crossbar; a first lug extending from said first socket, said first lug receiving said first stanchion and being supported on said first collar; a second socket receiving a second end of said crossbar; a second lug extending from said second socket, said second lug receiving said second stanchion and being supported on said second collar.

Aspect 10: A training device securable to a floor, said training device comprising: a first suction cup attachable to said floor; a first flexible element attached to said first suction cup; a first stanchion extending from said first flexible element transversely to said floor; a second suction cup attachable to said floor; a second flexible element attached to said second suction cup; a second stanchion extending from said second flexible element transversely to said floor; a crossbar extending from said first stanchion to said second stanchion; wherein said first and second flexible elements each have bending stiffnesses less than a bending stiffness of said first and second stanchions respectively.

Aspect 11: The training device according to aspect 10, wherein each of said first and second stanchions comprises: a first tube positioned coaxially within a second tube, said first tube being attached to said flexible element, said cross bar being attached to said second tube, said first and second tubes being axially movable relatively to one another.

Aspect 12: The training device according to aspect 11, further comprising, for each said stanchion, a detent operating between said first and second tubes for fixing a length of said first and second stanchions.

Aspect 13: The training device according to any one of aspects 10-12, wherein said crossbar comprises: a first tube positioned coaxially within a second tube, said first and second tubes being axially movable relatively to one another.

Aspect 14: The training device according to aspect 13, further comprising a detent operating between said first and second tubes for fixing a length of said crossbar.

Aspect 15: The training device according to any one of aspects 10-15, wherein said first and second flexible elements comprise respective coil springs.

Aspect 16: The training device according to any one of aspects 10-15, wherein said first and second flexible elements comprise respective elastomeric bodies.

Aspect 17: A training device securable to a floor, said training device comprising: a first suction cup attachable to said floor; a first tube having a first end attached to said first suction cup and a second end oppositely disposed; a second suction cup attachable to said floor; a second tube having a first end attached to said second suction cup and a second end oppositely disposed; a crossbar extending between said second ends of said first and second tubes, said cross bar having first and second ends oppositely disposed; a first fitting having a first receptacle receiving said second end of said first tube and a second receptacle receiving said first end of said crossbar, said first and second receptacles of said first fitting being angularly oriented with respect to one another; a second fitting having a first receptacle receiving said second end of said second tube and a second receptacle receiving said second end of said cross bar, said first and second receptacles of said second fitting being angularly oriented with respect to one another.

Aspect 18: The training device according to aspect 17, further comprising: a first flexible element positioned between said first suction cup and said first end of said first tube; a second flexible element positioned between said second suction cup and said first end of said second tube; wherein said first and second flexible elements each have bending stiffnesses less than a bending stiffness of said first and second tubes respectively.

Aspect 19: The training device according to aspect 18, wherein said first and second flexible elements comprise respective coil springs.

Aspect 20: The training device according to aspect 18 or aspect 19, wherein said first and second flexible elements comprise respective elastomeric bodies.

Aspect 21: The training device according to any one of aspects 17-20, wherein said first tube is coaxially received within said first receptacle of said first fitting and said second tube is coaxially received within said first receptacle of said second fitting, said first tube being axially movable relatively to said first receptacle of said first fitting and said second tube being axially movable relatively to said first receptacle of said second fitting.

Aspect 22: The training device according to aspect 21, further comprising: a first detent operating between said first tube and said first fitting; a second detent operating between said second tube and said second fitting, said first and second detents for fixing a height of said crossbar above said floor.

Aspect 23: The training device according to any one of aspects 17-22, wherein said first end of said crossbar is coaxially received within said second receptacle of said first fitting and said second end of said crossbar is coaxially received within said second receptacle of said second fitting, said crossbar being axially movable relatively to said second receptacle of said first fitting and said second receptacle of said second fitting.

Aspect 24: The training device according to aspect 23, further comprising: a first detent operating between said crossbar and said first fitting; a second detent operating between said crossbar and said second fitting, said first and second detents for fixing a separation distance between said first and second tubes.

Aspect 25: A training device positionable on a floor, said training device comprising: a first trapezoidal base comprising a long side and a short side attached to one another by first and second legs oriented angularly with respect to said long and short sides, said long side adapted to engage said floor; a first stanchion extending from said first trapezoidal base transversely to said floor; a second trapezoidal base comprising a long side and a short side attached to one another by first and second legs oriented angularly with respect to said long and short sides of said second trapezoidal base, said long side of said second trapezoidal base adapted to engage said floor; a second stanchion extending from said second trapezoidal base transversely to said floor; a crossbar extending from said first stanchion to said second stanchion, said crossbar being oriented transversely to said long side of at least one of said first and second trapezoidal bases.

Aspect 26: The training device according to aspect 25, wherein at least one of said first and second trapezoidal bases has a flexible, resilient layer positioned on one of said long sides for engaging said floor.

Aspect 27: The training device according to aspect 26, wherein said flexible, resilient layer comprises a plurality of pads positioned in spaced relation to one another on said long side of said at least one trapezoidal base.

Aspect 28: The training device according to any one of aspects 25-27, wherein each of said first and second stanchions comprises a plurality of tubes positioned coaxially one within another, said tubes being movable relatively to one another.

Aspect 29: The training device according to aspect 28, wherein at least one of said stanchions comprises a first tube positioned coaxially within a second tube, said second tube being coaxially positioned within a third tube, said third tube being attached to said base, said cross bar being attached to said first tube.

Aspect 30: The training device according to aspect 28 or aspect 29, further comprising, for each said stanchion, a detent operating between each of said tubes for fixing a length of said first and second stanchions.

Aspect 31: The training device according to any one of aspects 25-30, wherein said crossbar comprises a plurality of cross tubes positioned coaxially one within another, said cross tubes being movable relatively to one another.

Aspect 32: The training device according to aspect 31, wherein said crossbar comprises a first cross tube positioned coaxially within a second cross tube, said first and second cross tubes being axially movable relatively to one another.

Aspect 33: The training device according to aspect 32, further comprising a detent operating between said first and second cross tubes for fixing a length of said crossbar.

Aspect 34: The training device according to aspect 31, wherein said crossbar comprises: a first socket positioned at an end of said first cross tube, said first socket defining a first opening for receiving said first stanchion; a second socket positioned at an end of said second cross tube, said second socket defining a second opening for receiving said second stanchion; wherein said first and second openings are oriented transversely to said first and second tubes respectively.

Aspect 35: The training device according to aspect 34, wherein said first socket is integrally formed with said first tube.

Aspect 36: The training device according to aspect 35, wherein said second socket is integrally formed with said second tube.

Aspect 37: A training device securable to a floor, the training device comprising: a first base having at least one attachment member for attaching the first base to the floor; a first stanchion having a first end attached to the first base and a second end oppositely disposed, the first stanchion extending upwardly from the first base transversely to the floor; a second base having at least one attachment member for attaching the second base to the floor; a second stanchion having a first end attached to the second base and a second end oppositely disposed, the second stanchion extending upwardly from the second base transversely to the floor; and a crossbar extending between the second ends of the first and second stanchions, the crossbar having first and second ends oppositely disposed; a first connector mounted proximate to the second end of the first stanchion, the first connector having a first receptacle for receiving the first end of the crossbar; a second connector mounted proximate to the second end of the second stanchion, the second connector having a second receptacle for receiving the second end of the crossbar.

Aspect 38: The training device according to aspect 37, wherein the at least one attachment member of the first and second bases comprises at least one of a suction cup, a vacuum cup, an adhesive, a clamp, a latch, a bolt, a screw, and combinations thereof.

Aspect 39: The training device according to any one of aspects 37-38, wherein each of the first and second stanchions comprise a first tube positioned coaxially within a second tube, the second tube being attached to the base, the cross bar being attached to the first tube, the first and second tubes being axially movable relatively to one another.

Aspect 40: The training device according to aspect 39, further comprising, for each of the first and second stanchions, a detent operable between the first and second tubes for fixing a length of the first and second stanchions.

Aspect 41: The training device according to any one of aspects 37-40, wherein each of the first and second stanchions comprises a plurality of tubes positioned coaxially one within another, the plurality of tubes being movable relative to one another.

Aspect 42: The training device according to aspect 41, wherein at least one of the first and second stanchions comprises a first tube positioned coaxially within a second tube, the second tube being coaxially positioned within a third tube, the third tube being attached to the base, the crossbar being attached to the first tube.

Aspect 43: The training device according to aspect 41 or aspect 42, further comprising, for each of the first and second stanchions, a detent operable between each of the tubes for fixing a length of the first and second stanchions.

Aspect 44: The training device according to any one of aspects 37-43, wherein the crossbar comprises a first tube positioned coaxially within a second tube, the first and second tubes being axially movable relative to one another.

Aspect 45: The training device according to aspect 44, further comprising a detent operable between the first and second tubes for fixing a length of the crossbar.

Aspect 46: The training device according to any one of aspects 37-45, wherein the crossbar comprises a plurality of cross tubes positioned coaxially one within another, the cross tubes being movable relative to one another.

Aspect 47: The training device according to aspect 46, further comprising a detent operable between each of the cross tubes for fixing a length of the crossbar.

Aspect 48: A training device securable to a floor, the training device comprising: a first attachment member attachable to the floor; a first tube having a first end and a second end oppositely disposed, the first tube extending transversely the floor; a first flexible element disposed between the first attachment member and the first end of the first tube; a second attachment member attachable to the floor; a second tube having a first end and a second end oppositely disposed, the second tube extending transversely to the floor; a second flexible element disposed between the second attachment member and the first end of the second tube, the first and second flexible elements each have bending stiffnesses less than a bending stiffness of the first and second tubes respectively; a crossbar extending between the second ends of the first and second tubes, the crossbar having first and second ends oppositely disposed; a first fitting having a first receptacle for receiving the second end of the first tube and a second receptacle for receiving the first end of the crossbar, the first and second receptacles of the first fitting being angularly oriented with respect to one another; a second fitting having a first receptacle for receiving the second end of the second tube and a second receptacle for receiving the second end of the cross bar, the first and second receptacles of the second fitting being angularly oriented with respect to one another.

Aspect 49: The training device according to aspect 48, wherein the first and second flexible elements comprise respective coil springs, elastomeric bodies, or both.

Aspect 50: The training device according to aspect 48 or aspect 49, wherein the first tube is coaxially received within the first receptacle of the first fitting and the second tube is coaxially received within the first receptacle of the second fitting, the first tube being axially movable relatively to the first receptacle of the first fitting and the second tube being axially movable relatively to the first receptacle of the second fitting.

Aspect 51: The training device according to any one of aspects 48-50, further comprising: a first detent operable between the first tube and the first fitting; and a second detent operable between the second tube and the second fitting, the first and second detents for fixing a height of the crossbar above the floor.

Aspect 52: The training device according to any one of aspects 48-51, wherein the first end of the crossbar is coaxially received within the second receptacle of the first fitting and the second end of the crossbar is coaxially received within the second receptacle of the second fitting, the crossbar being axially movable relatively to the second receptacle of the first fitting and the second receptacle of the second fitting.

Aspect 53: The training device according to any one of aspects 48-52, further comprising: a first detent operable between the crossbar and the first fitting; a second detent operable between the crossbar and the second fitting, the first and second detents for fixing a separation distance between the first and second tubes.

Aspect 54: A training device positionable on a floor, the training device comprising: a first base comprising a first side and an opposed second side attached to one another by at least first and second legs oriented angularly with respect to the first and second sides of the first base, the first side adapted to engage the floor; a first stanchion extending from the first base transversely relative to the floor; a second base comprising a first side and a second side attached to one another by at least first and second legs oriented angularly with respect to the first and second sides of the second base, the first side of the second base adapted to engage the floor; a second stanchion extending from the second base transversely relative to the floor; a crossbar extending from the first stanchion to the second stanchion, the crossbar being oriented transversely to the first side of at least one of the first and second bases.

Aspect 55: The training device according to aspect 54, wherein at least one of the first and second bases has a flexible, resilient layer positioned on the first side for engaging the floor.

Aspect 56: The training device according to aspect 54 or aspect 55, wherein the flexible, resilient layer comprises a plurality of pads positioned in spaced relation to one another along the first side of the at least one base.

Aspect 57: The training device according to any one of aspects 54-56, wherein each of the first and second stanchions comprises a plurality of tubes positioned coaxially one within another, the tubes being movable relatively to one another.

Aspect 58: The training device according to any one of aspects 54-57, wherein at least one of the stanchions comprises a first tube positioned coaxially within a second tube, the second tube being coaxially positioned within a third tube, the third tube being attached to the base, the crossbar being attached to the first tube.

Aspect 59: The training device according to aspect 57 or aspect 58, further comprising, for each the stanchion, a detent operable between each of the tubes for fixing a length of the first and second stanchions.

Aspect 60: The training device according to any one of aspects 54-59, wherein the crossbar comprises a plurality of cross tubes positioned coaxially one within another, the cross tubes being movable relatively to one another.

Aspect 61: The training device according to any one of aspects 54-60, wherein the crossbar comprises a first cross tube positioned coaxially within a second cross tube, the first and second cross tubes being axially movable relatively to one another.

Aspect 62: The training device according to aspect 61, further comprising a detent operable between the first and second cross tubes for fixing a length of the crossbar.

Aspect 63: The training device according to aspect 61 or aspect 62, wherein the crossbar comprises: a first socket positioned at an end of the first cross tube, the first socket defining a first opening for receiving the first stanchion; and a second socket positioned at an end of the second cross tube, the second socket defining a second opening for receiving the second stanchion, wherein the first and second openings are oriented transversely to the first and second tubes respectively.

Aspect 64: The training device according to aspect 63, wherein the first socket is integrally formed with the first tube, Aspect 65: The training device according to aspect 63 or aspect 64, wherein the second socket is integrally formed with the second tube.

All publications and patent applications mentioned in the specification are indicative of the level of those skilled in the art to which this invention pertains. All publications and patent applications are herein incorporated by reference to the same extent as if each individual publication or patent application was specifically and individually indicated to be incorporated by reference.

Although the foregoing invention has been described in some detail by way of illustration and example for purposes of clarity of understanding, certain changes and modifications may be practiced within the scope of the appended claims.

What is claimed is:

1. A training device positionable on a floor, the training device comprising:

a first trapezoidal base comprising:

a long side and a short side attached to one another by first and second legs oriented angularly with respect to the long and short sides of the first trapezoidal base;

a first hole defined in the first leg of the first trapezoidal base; and a second hole defined in the long side of the base, wherein each of the first leg and the second leg extends between and is connected to the long side and the short side, wherein the long side and the short side define respective transverse surfaces that extend continuously from the first leg to the second leg, the long side of the first trapezoidal base adapted to engage the floor and defining a bottom surface of the first trapezoidal base, wherein the first hole is aligned with the second hole to permit receipt of a portion of the crossbar through the first and second holes;

a first stanchion extending from the first trapezoidal base transversely relative to the floor, wherein the first stanchion is welded to the long side and the short side of the first trapezoidal base;

a second trapezoidal base comprising:

a long side and a short side attached to one another by first and second legs oriented angularly with respect to the long and short sides of the second trapezoidal base;

a first hole defined in the first leg of the second trapezoidal base; and a second hole defined in the long side of the base, wherein each of the first leg and the second leg of the second trapezoidal base extends between and is connected to the long side and the short side of the second trapezoidal base, wherein the long side and the short side define respective transverse surfaces that extend continuously from the first leg to the second leg, the long side of the second trapezoidal base adapted to engage the floor and defining a bottom surface of the second trapezoidal base, wherein the first hole is aligned with the second hole to permit receipt of a portion of the crossbar through the first and second holes;

a second stanchion extending from the second trapezoidal base transversely relative to the floor, wherein the second stanchion is welded to the long side and the short side of the second trapezoidal base;

a crossbar extending from the first stanchion to the second stanchion, the crossbar being oriented transversely to the long side of at least one of the first and second trapezoidal bases, wherein the crossbar comprises a plurality of cross tubes positioned coaxially one within another, the cross tubes being movable relatively to one another, and wherein the crossbar is detachable from the first and second stanchions;

a first socket positioned at an end of a first cross tube, the first socket defining a first opening for receiving the first stanchion; and a second socket positioned at an end of a second cross tube, the second socket defining a second opening for receiving the second stanchion, wherein the first and second openings are oriented transversely to the first and second cross tubes respectively, wherein the first socket is integrally formed with the first cross tube, and wherein the second socket is integrally formed with the second cross tube, wherein the first and second trapezoidal bases have a flexible, resilient layer positioned on the transverse surface of the long side for engaging the floor, and wherein the flexible, resilient layer comprises a plurality of pads positioned in spaced relation to one another along the transverse surface of the long side of the first and second trapezoidal bases.

2. The training device according to claim 1, wherein each of the first and second stanchions comprises a plurality of tubes positioned coaxially one within another, the tubes being movable relatively to one another.

3. The training device according to claim 2, wherein at least one of the stanchions comprises a first tube positioned coaxially within a second tube, the second tube being coaxially positioned within a third tube, the third tube being welded to the base, the crossbar being attached to the first tube.

4. The training device according to claim 2, further comprising, for each of the first and second stanchions, a detent operable between each of the tubes for fixing a length of the stanchion.

5. The training device according to claim 1, wherein the first cross tube is positioned coaxially within the second cross tube, the first and second cross tubes being axially movable relatively to one another.

6. The training device according to claim 5, further comprising a detent operable between the first and second cross tubes for fixing a length of the crossbar.

7. The training device of claim 1, wherein each of the first and second trapezoidal bases further comprises:

a third hole defined the first leg of the base, wherein the third hole is in spaced relation to the first hole; and a fourth hole defined in the long side of the base, wherein the fourth hole is in spaced relation to the second hole, wherein the first hole is aligned with the second hole to permit receipt of a first portion of the crossbar through the first and second holes, and wherein the third hole is aligned with the fourth hole to permit receipt of a second portion of the crossbar through the third and fourth holes.

8. The training device of claim 1, wherein the first stanchion extends upwardly from the short side of the first trapezoidal base, and wherein the second stanchion extends upwardly from the short side of the second trapezoidal base.

9. A training device positionable on a floor, the training device comprising:

first and second trapezoidal bases, each of the first and second trapezoidal bases comprising a long side, a short side, a first leg, and a second leg, wherein the long side and the short side are attached to one another by the first and second legs, wherein the first and second legs are oriented angularly with respect to the long and short sides, wherein each of the first leg and the second leg extends between and is connected to the long side and the short side, wherein the long side and the short side define respective transverse surfaces that extend continuously from the first leg to the second leg, the long side of each trapezoidal base adapted to engage the floor and defining a bottom surface of the trapezoidal base, wherein each of the first and second trapezoidal bases comprises:

a first hole defined in the first leg of the base; and a second hole defined in the long side of the base, wherein the first hole is aligned with the second hole to permit receipt of a portion of the crossbar through the first and second holes;

a first stanchion extending from the first trapezoidal base transversely relative to the floor, wherein the first stanchion is welded to the long side and the short side of the first trapezoidal base;

a second stanchion extending from the second trapezoidal base transversely relative to the floor, wherein the second stanchion is welded to the long side and the short side of the second trapezoidal base; and a crossbar extending from the first stanchion to the second stanchion, the crossbar being oriented transversely to the long side of at least one of the first and second trapezoidal bases, and wherein the crossbar is detachable from the first and second stanchions.

10. The training device of claim 9, wherein each of the first and second trapezoidal bases further comprises:

a third hole defined in the first leg of the base, wherein the third hole is in spaced relation to the first hole; and a fourth hole defined in the long side of the base, wherein the fourth hole is in spaced relation to the second hole, wherein the first hole is aligned with the second hole to permit receipt of a first portion of the crossbar through the first and second holes, and wherein the third hole is aligned with the fourth hole to permit receipt of a second portion of the crossbar through the third and fourth holes.

* * * * *